US009428967B2

(12) United States Patent
Scott et al.

(10) Patent No.: US 9,428,967 B2
(45) Date of Patent: Aug. 30, 2016

(54) POLYCRYSTALLINE COMPACT TABLES FOR CUTTING ELEMENTS AND METHODS OF FABRICATION

(71) Applicant: Baker Hughes Incorporated, Houston, TX (US)

(72) Inventors: Danny E. Scott, Montgomery, TX (US); Michael L. Doster, Spring, TX (US); Anthony A. DiGiovanni, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 625 days.

(21) Appl. No.: 13/794,364

(22) Filed: Mar. 11, 2013

(65) Prior Publication Data

US 2014/0246252 A1 Sep. 4, 2014

Related U.S. Application Data

(60) Provisional application No. 61/771,404, filed on Mar. 1, 2013.

(51) Int. Cl.
*E21B 10/56* (2006.01)
*E21B 10/573* (2006.01)
*E21B 10/567* (2006.01)

(52) U.S. Cl.
CPC ..... *E21B 10/5735* (2013.01); *E21B 10/5676* (2013.01); *E21B 2010/563* (2013.01)

(58) Field of Classification Search
CPC ..... E21B 10/46; E21B 10/52; E21B 10/56; E21B 10/5676
USPC ..... 175/425, 426, 433, 434; 51/309
See application file for complete search history.

(56) References Cited

U.S. PATENT DOCUMENTS 4,128,136 A 12/1978 Generoux
4,224,380 A 9/1980 Bovenkerk et al.

(Continued)

FOREIGN PATENT DOCUMENTS

EP 0462955 A1 12/1991
EP 0582484 A1 2/1994

(Continued)

OTHER PUBLICATIONS

International Search Report for International Application No. PCT/US2014/019398, (dated Jun. 19, 2014), 4 pages.

(Continued)

*Primary Examiner* — Kenneth L Thompson
(74) *Attorney, Agent, or Firm* — TraskBritt

(57) ABSTRACT

Polycrystalline compact tables for cutting elements include regions of grains of super hard material. One region of grains ("first grains") and another region of grains ("second grains") have different properties, such as different average grain sizes, different super hard material volume densities, or both. The region of first grains and the region of second grains adjoin one another at grain interfaces that may include a curved portion in a vertical cross-section of the table. In some embodiments, discrete regions of the first grains may be vertically disposed between discrete regions of the second grains. As such, the tables have ordered grain regions of different properties that may inhibit delamination and crack propagation through the table when used in conjunction with a cutting element. Methods of forming the tables include forming the regions and subjecting the grains to a high-pressure, high-temperature process to sinter the grains.

20 Claims, 12 Drawing Sheets

(56) References Cited

U.S. PATENT DOCUMENTS 4,255,165 A 3/1981 Dennis et al.
4,378,975 A 4/1983 Tomlinson et al.
4,525,179 A * 6/1985 Gigl ..... B01J 3/062 219/69.12
4,592,433 A 6/1986 Dennis
4,605,343 A 8/1986 Hibbs, Jr. et al.
4,627,503 A 12/1986 Horton
4,772,524 A 9/1988 Coblenz
4,866,885 A 9/1989 Dodsworth
4,984,642 A 1/1991 Renard et al.
5,007,207 A 4/1991 Phaal
5,096,465 A * 3/1992 Chen ..... B23B 27/148 51/293
5,127,923 A 7/1992 Bunting et al.
5,135,061 A 8/1992 Newton, Jr.
5,217,081 A 6/1993 Waldenström et al.
5,238,074 A 8/1993 Tibbitts et al.
5,266,388 A 11/1993 Santhanam et al.
5,273,379 A 12/1993 Nishimura
5,297,456 A 3/1994 Nishimura
5,355,969 A 10/1994 Hardy et al.
5,379,854 A 1/1995 Dennis
5,419,868 A 5/1995 Honnorat
5,441,817 A 8/1995 Rai
5,478,634 A 12/1995 Setoyama et al.
5,492,188 A 2/1996 Smith et al.
5,503,912 A 4/1996 Setoyama et al.
5,527,215 A 6/1996 Rubino et al.
5,544,713 A 8/1996 Dennis
5,590,728 A 1/1997 Matthias et al.
5,611,649 A 3/1997 Matthias
5,617,928 A 4/1997 Matthias et al.
5,630,479 A 5/1997 Dennis
5,645,781 A 7/1997 Popovic' et al.
5,662,183 A 9/1997 Fang
5,690,540 A 11/1997 Elliott et al.
5,709,907 A 1/1998 Battaglia et al.
5,722,803 A 3/1998 Battaglia et al.
5,766,394 A 6/1998 Anderson et al.
5,813,105 A 9/1998 Littecke et al.
5,830,813 A 11/1998 Yao et al.
5,862,873 A * 1/1999 Matthias ..... E21B 10/5735 175/432
5,868,885 A 2/1999 Crockett et al.
5,880,382 A 3/1999 Fang et al.
5,944,127 A 8/1999 Liang et al.
5,944,583 A 8/1999 Cruz et al.
5,976,716 A 11/1999 Inspektor
5,984,769 A 11/1999 Bennett et al.
6,025,076 A 2/2000 Collins
6,054,185 A 4/2000 Inspektor
6,063,502 A 5/2000 Sue et al.
6,103,357 A 8/2000 Selinder et al.
6,117,533 A 9/2000 Inspektor
6,135,865 A 10/2000 Beardsley et al.
6,148,937 A 11/2000 Mensa-Wilmot et al.
6,149,695 A 11/2000 Adia et al.
6,187,068 B1 2/2001 Frushour et al.
6,189,634 B1 2/2001 Bertagnolli et al.
6,193,001 B1 2/2001 Eyre et al.
6,258,139 B1 7/2001 Jensen
6,286,498 B1 * 9/2001 Sung ..... B01J 3/062 125/12
6,309,738 B1 10/2001 Sakurai
6,325,165 B1 12/2001 Eyre
6,333,099 B1 12/2001 Strondl et al.
6,361,873 B1 3/2002 Yong et al.
6,401,845 B1 6/2002 Fielder
6,446,740 B2 9/2002 Eyre
6,593,015 B1 7/2003 Inspektor
6,655,481 B2 12/2003 Findley et al.
6,660,133 B2 12/2003 Penich et al.
6,696,137 B2 2/2004 Yong
6,742,611 B1 6/2004 Illerhaus et al.
6,841,260 B2 1/2005 Sue et al.
6,884,499 B2 4/2005 Penich et al.
7,179,023 B2 2/2007 Goudemond et al.
7,435,377 B2 10/2008 Cho et al.
7,487,849 B2 2/2009 Radtke
7,585,342 B2 9/2009 Cho
7,694,757 B2 * 4/2010 Keshavan ..... B22F 7/06 175/374
7,842,111 B1 11/2010 Sani
8,109,350 B2 2/2012 Fang et al.
8,191,658 B2 6/2012 Schmitz et al.
8,910,730 B2 * 12/2014 Griffin ..... B22F 7/06 175/426
9,097,074 B2 * 8/2015 Shen ..... E21B 10/567
2002/0007972 A1 1/2002 Yong et al.
2002/0014355 A1 * 2/2002 Eyre ..... E21B 10/5676 175/425
2003/0051924 A1 3/2003 Tsuda et al.
2005/0133277 A1 6/2005 Dixon
2006/0254830 A1 11/2006 Radtke
2007/0298232 A1 12/2007 McNerny et al.
2008/0023230 A1 1/2008 Cho
2008/0166588 A1 7/2008 Astrand
2009/0067938 A1 3/2009 Omori et al.
2009/0071724 A1 3/2009 Drivdahl et al.
2009/0078469 A1 3/2009 Drivdahl et al.
2009/0218146 A1 9/2009 Fang et al.
2010/0008738 A1 1/2010 Drivdahl et al.
2010/0012389 A1 * 1/2010 Zhang ..... B24D 99/005 175/432
2010/0242375 A1 * 9/2010 Hall ..... B22F 3/14 51/307
2010/0255199 A1 10/2010 Gates, Jr. et al.
2010/0255345 A1 10/2010 Ban et al.
2011/0031034 A1 2/2011 DiGiovanni et al.

FOREIGN PATENT DOCUMENTS

GB 1572460 A 7/1980
GB 2261894 B 7/1995
GB 2279677 B 8/1996
WO 2007089590 A2 8/2007
WO 2011158190 A2 12/2011

OTHER PUBLICATIONS

International Written Opinion for International Application No. PCT/US2014/019398, (dated Jun. 19, 2014), 8 pages.

* cited by examiner

POLYCRYSTALLINE COMPACT TABLES FOR CUTTING ELEMENTS AND METHODS OF FABRICATION

CROSS-REFERENCE TO RELATED APPLICATION

This application claims the benefit of the filing date of U.S. Provisional Patent Application No. 61/771,404, filed Mar. 1, 2013, the disclosure of which is hereby incorporated herein in its entirety by this reference.

FIELD

Embodiments of the present disclosure relate to polycrystalline compacts and to methods of farming such polycrystalline compacts.

BACKGROUND

Earth-boring tools for forming wellbores in subterranean earth formations generally include a plurality of cutting elements secured to a body. For example, fixed-cutter earth-boring rotary drill bits (also referred to as "drag bits") include a plurality of cutting elements fixedly attached to a bit body of the fixed-cutter drill bit. Similarly, roller cone earth-boring rotary drill bits include cones that are mounted on bearing pins extending from legs of a bit body such that each cone is capable of rotating about the bearing pin on which it is mounted. A plurality of cutting elements may be mounted to each cone of such a roller cone drill bit.

The cutting elements used in fixed-cutter, roller cone, and other earth-boring tools often include polycrystalline compact cutting elements, e.g., polycrystalline diamond compact ("PDC") cutting elements. The polycrystalline compact cutting elements include cutting faces of a polycrystalline compact of a polycrystalline material such as diamond or another super hard material (collectively referred to herein as "super hard material").

Polycrystalline compact cutting elements may be formed by sintering and bonding together grains or crystals of super hard material in the presence of a metal solvent catalyst. (The terms "grain" and "crystal" are used synonymously and interchangeably herein.) The super hard material grains are sintered and bonded under high temperature and high pressure conditions (referred to herein as "high pressure, high temperature processes" ("HPHT processes") or "high temperature, high pressure processes" ("HTHP processes")). The HPHT process forms direct, inter-granular bonds between the grains of super hard material, and the inter-granularly bonded grains form a "table" of the polycrystalline material (e.g., diamond or alternative super hard material). The table may be formed on or later joined to a cutting element supporting substrate.

BRIEF SUMMARY

In some embodiments, the present disclosure includes a polycrystalline compact table for a cutting element, the table comprising a first region of super hard material grains having a first property and a second region of super hard material grains having a second property differing from the first property. The first region and the second region define a grain interface having a curved portion in a vertical cross-section of the table.

In other embodiments, the present disclosure includes a polycrystalline compact table for a cutting element, the table comprising a first plurality of discrete regions of first grains of a super hard material and a second plurality of discrete regions of second grains of the super hard material. The second grains having a different property than a property of the first grains. At least one discrete region of the first plurality is vertically disposed between at least two discrete regions of the second plurality.

The disclosure also includes a method of forming a polycrystalline compact for a cutting element of a drilling tool. The method comprises forming a table structure. Forming a table structure comprises forming a first region of first grains of super hard material having a first property and forming a second region of second grains of super hard material having a second property. The table structure is subjected to a high-pressure, high-temperature process to sinter the first grains and the second grains.

BRIEF DESCRIPTION OF THE DRAWINGS

While the specification concludes with claims particularly pointing out and distinctly claiming what are regarded as embodiments of the disclosure, various features and advantages of this disclosure may be more readily ascertained from the following description of example embodiments provided with reference to the accompanying drawings, in which:

DETAILED DESCRIPTION

Figure 1:
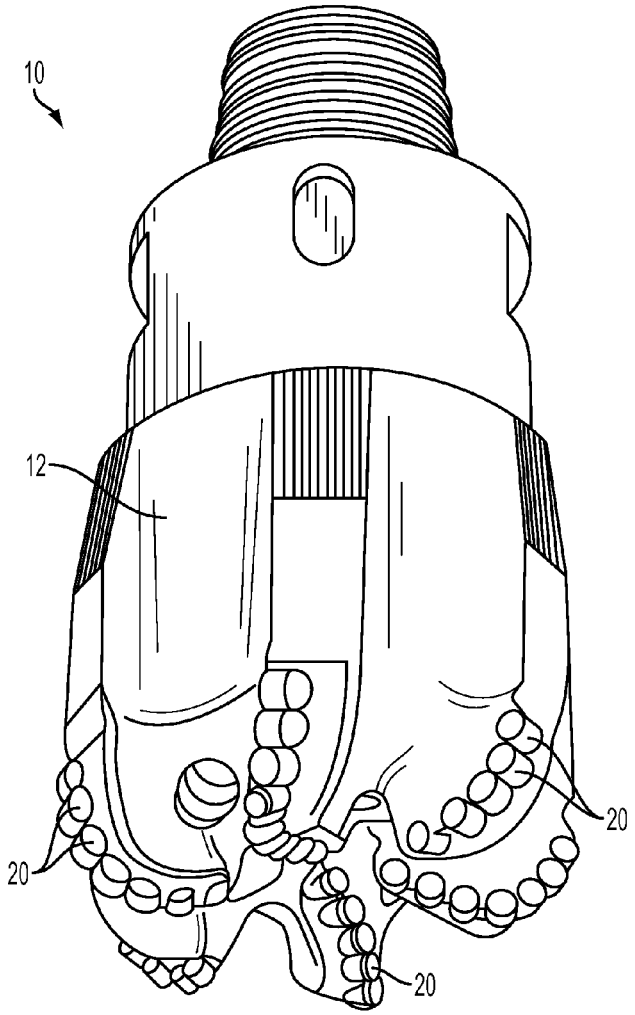
FIG. 1 is a perspective view of a fixed-cutter earth-boring rotary drill bit that includes cutting elements according to embodiments of the present disclosure.

Earth-boring tools, and the cutting elements thereof, are often used in harsh downhole environments. Therefore, cutting elements are often subjected to heat, during use, due to friction at the contact point between the cutting element and earth formations. This heat and abrasive interaction may lead to thermal and structural damage during drilling. For example, differences in coefficients of thermal expansion between various materials within the cutting element may lead to cracks or delamination at interfaces between the various materials. That is, materials may expand or contract at different rates and contribute to thermal damage in the polycrystalline table when the cutting element is heated during use or thereafter cooled. Thus, when the cutting element is used to cut formation material, friction between the cutting element and the bore-wall surface heats the cutting element, and materials such as carbides within the supporting substrate may expand twice as fast as the super hard material such as diamond within the polycrystalline table. The expansion can lead to structural failure in the atomic microstructure of the materials within the polycrystalline material. Additionally, abrasive interactions with earth formations may also lead to cracks in the exterior surface of the cutting element. What begin as structural failures in the microstructure or small cracks, e.g., in the table of the cutting element, may lead to larger cracks propagating further into the cutting element. Particularly along interfaces, such failures may lead to delamination. Even aside from interfaces, crack propagation may ultimately lead to destruction of the cutting element itself.

The present polycrystalline compact tables include ordered regions of super hard material with different properties, such as different average grain sizes, different super hard material volume density, or both, wherein one grain region adjoins another grain region at a grain interface. The ordered grain regions of different properties and the grain interfaces between the regions may inhibit delamination and crack propagation through the table when the table is used in conjunction with a cutting element.

Cutting elements including tables according to embodiments of the present disclosure may be configured to be used in harsh downhole environments. The cutting elements may be subjected to heat, during use, due to friction at the contact point between the cutting element and earth formations. In use, this heat and abrasive interaction may lead to mechanical stress on the cutting elements due to, for example, differences in coefficients of thermal expansion between various materials within the cutting element. Materials in the cutting element may expand or contract at different rates and contribute to strain in the polycrystalline table when the cutting element is heated during use or thereafter cooled. Abrasive interactions with earth formations may also exert a stress on the cutting element. The ordered grain regions of the table of the cutting elements, according to embodiments of the present disclosure, may be configured to inhibit delamination or crack propagation despite the stress on the table and other components of the cutting element in use. For example, if a crack in the table is initiated at a lateral side of the table, the crack's propagation may be halted or diverted toward a mechanically strong region of the table when the crack intercepts a grain region of a different property, such as a different average grain size or different super hard material volume density, at a grain interface. The relative sizes, shapes, and locations of the grain regions within the table may be tailored to inhibit delamination and crack propagation.

As used herein, the term "drill bit" means and includes any type of bit or tool used for drilling during the formation or enlargement of a wellbore and includes, for example, rotary drill bits, percussion bits, core bits, eccentric bits, bicenter bits, reamers, expandable reamers, mills, drag bits, roller cone bits, hybrid bits, and other drilling bits and tools known in the art.

As used herein, the term "polycrystalline material" means and includes any material comprising a plurality of grains (also referred to herein as "crystals") of the material that are bonded directly together by inter-granular bonds. The crystal structures of the individual grains of the material may be randomly oriented in space within the polycrystalline material.

As used herein, the term "polycrystalline compact" means and includes any structure comprising a polycrystalline material formed by a process that involves application of pressure (e.g., compaction) to the precursor material (or materials) used to form the polycrystalline material. As used herein, the term "polycrystalline compact" is synonymous with the terms "table" and "polycrystalline compact table."

As used herein, the term "super hard material" means and includes any material having a Knoop hardness value of about 2,000 $Kg/mm^2$ (20 GPa) or more. In some embodiments, the super hard materials employed herein may have a Knoop hardness value of about 3,000 $Kg/mm^2$ (29.4 GPa) or more. Such materials include, for example, diamond and cubic boron nitride.

As used herein, the term "super hard material volume density" refers to the density (mass per volume) of the super hard material in an identified volume of material (e.g., a volume of grain region or a volume of the table).

As used herein, "first," "second," "third," etc., are terms used to describe one item or plurality of items distinctly from another item or plurality of items. They are not necessarily meant to imply a temporal sequence unless otherwise specified. Accordingly, a region of "first grains" may not necessarily have been fabricated prior to a region of "second grains," unless otherwise specified. Furthermore, an average grain size or a super hard material volume density of what are referred to as "first grains" in one embodiment herein may be the average grain size or the super hard material volume density of what are referred to as "second grains" in another embodiment herein.

As used herein, the relative terms "large," "medium," and "small" are terms used to describe the average grain size of one plurality of grains of super hard material relative to the average grain size of another plurality of grains of super hard material. Therefore, while, in one embodiment, a plurality of grains may be referred to herein as "medium grains," in another embodiment, grains of the same size may be referred to as "small grains" or "large grains," depending on the presence and relative average size of other pluralities of grains in those embodiments.

As used herein, the term "discrete," when used in reference to a region or feature, means a region or feature having opposing uppermost and lowest elevations that are not both coplanar with an uppermost and lowest surface of the table and having opposing widest points (e.g., lateral surfaces) that are not both coplanar with exterior lateral surfaces (e.g., sidewalls) of the table. For example, a "discrete" region may have an uppermost surface that is coplanar with an uppermost surface of the table, a sidewall that is coplanar with an exterior sidewall of the table, but a lowest surface that is disposed within the table (not coplanar with the lowest surface of the table), and an opposing sidewall that is disposed within the table (not coplanar with an opposing exterior sidewall of the table).

As used herein, the term "inter-granular bond" means and includes any direct atomic bond (e.g., ionic, covalent, metallic, etc.) between atoms in adjacent grains of material.

As used herein, the term "catalyst material" refers to any material that is capable of substantially catalyzing the formation of inter-granular bonds between grains of super hard material during an HPHT process. For example, catalyst materials for diamond include cobalt, iron, nickel, other elements from Group VIIIA of the Period Table of Elements, and alloys and mixtures thereof. The catalyst material may, therefore, be a metal solvent catalyst.

As used herein, the term "nano-" when referring to any material, means and includes any material having an average particle diameter of about 500 nm or less.

As used herein, the term "between" is a spatially relative term used to describe the relative disposition of one material or region relative to at least two other materials or regions, respectively. The term "between" can encompass both a disposition of one material or region directly adjacent to the other materials or regions, respectively, and a disposition of one material or region not directly adjacent to the other materials or regions, respectively.

As used herein, reference to an element as being "on" or "over" another element means and includes the element being directly on top of, adjacent to, underneath, or in direct contact with the other element. It also includes the element being indirectly on top of, adjacent to, underneath, or near the other element, with other elements present therebetween. In contrast, when an element is referred to as being "directly on" or "directly adjacent to" another element, there are no intervening elements present.

As used herein, other spatially relative terms, such as "beneath," "below," "lower," "bottom," "above," "upper," "top," "front," "rear," "left," "right," and the like, may be used for ease of description to describe one element's or feature's relationship to another element(s) or feature(s) as illustrated in the figures. Unless otherwise specified, the spatially relative terms are intended to encompass different orientations of the materials in addition to the orientation as depicted in the figures. For example, if materials in the figures are inverted, elements described as "below" or "beneath" or "under" or "on bottom of" other elements or features would then be oriented "above" or "on top of" the other elements or features. Thus, the term "below" can encompass both an orientation of above and below, depending on the context in which the term is used, which will be evident to one of ordinary skill in the art. The materials may be otherwise oriented (rotated 90 degrees, inverted, etc.) and the spatially relative descriptors used herein interpreted accordingly.

As used herein, "and/or" includes any and all combinations of one or more of the associated listed items.

As used herein, the singular forms "a," "an," and "the" are intended to include the plural forms as well, unless the context clearly indicates otherwise.

The illustrations presented herein are not actual views of any particular drill bit, cutting element, component thereof, precursor structure therefore, or process stage. Rather, they are merely idealized representations that are employed to describe embodiments of the present disclosure.

FIG. 1 illustrates a fixed-cutter type earth-boring rotary drill bit 10 that includes a bit body 12 and cutting elements 20. In other embodiments, another type of drill bit, such as any of the drill bits previously discussed, may include cutting elements 20 of the form illustrated in FIG. 2 or in an alternate structure. The cutting elements (e.g., cutting elements 20 of FIG. 2) included with the drill bit (e.g., drill bit 10 of FIG. 1) may be formed in accordance with any of the structures or methods described herein.

Figure 2:
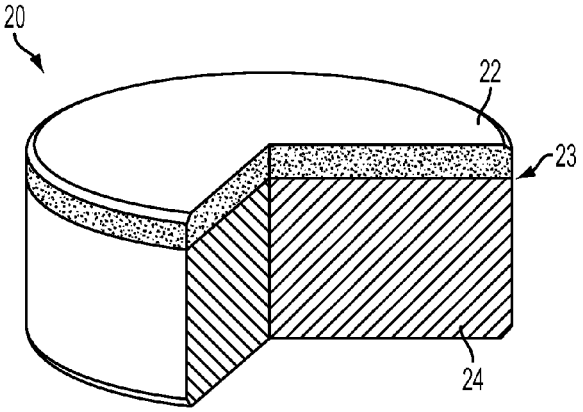
FIG. 2 is a top and front, partial cut-away, perspective view schematically illustrating a cutting element comprising a polycrystalline compact (also referred to herein as a "table") of the present disclosure.

FIG. 2 is a simplified, partial cut-away perspective schematic illustration of a cutting element 20 structure of the present disclosure. The cutting element 20 comprises a polycrystalline compact in the form of a region of super hard material that may be formed of diamond. The polycrystalline compact is also referred to herein as a "table" 22. The table 22 is provided on (e.g., formed on or attached to) a supporting substrate 24 with an interface 23 therebetween.

Though the cutting element 20 in the embodiment depicted in FIG. 2 is illustrated as cylindrical or disc-shaped, in other embodiments, the cutting element 20 may have any desirable shape, such as a dome, cone, chisel, etc. Additionally, though the interface 23 between the table 22 and the supporting substrate 24 of the cutting element 20 in the embodiment depicted in FIG. 2 is illustrated as horizontally planar, in other embodiments, as discussed below, the interface 23 may be non-horizontal, non-planar, or both. Furthermore, in some embodiments, the cutting element 20 may consist of a table 22 not disposed on any supporting substrate 24.

In some embodiments, the polycrystalline material of the table 22 comprises diamond. In such embodiments, the cutting element 20 may be referred to as a "polycrystalline diamond compact" (PDC) cutting element, wherein the table 22 may be referred to as a "diamond table." In other embodiments, the polycrystalline material of the table 22 may comprise another super hard material, such as, for example, polycrystalline cubic boron nitride (PCBN).

The supporting substrate 24 may include, for example, a cermet, such as, e.g., cobalt-cemented tungsten carbide.

A number of embodiments of tables are illustrated in FIGS. 3 through 25. Any of the illustrated embodiments may be substituted for the table 22 illustrated in FIG. 2 and utilized with a cutting element (e.g., cutting element 20) of a drill bit (e.g., the drill bit 10). Therefore, while the table 22 of FIG. 2 is illustrated as having a single region of super hard material, it is contemplated that, according to the present disclosure, the table 22 may include more than one defined region of super hard material. That is, the table 22 may include a first plurality of grains of super hard material having a first property (i.e., "first grains") and at least a second plurality of grains of super hard material having a second property (i.e., "second grains") that differs from the first property of the first plurality of grains. In some embodiments, the table 22 may also include a third plurality of grains of super hard material having a third property (i.e., "third grains") that differs from the properties of the first grains and the second grains. Additional pluralities of grains of super hard material having different properties may also be included.

The different properties of the first grains and the second grains, and additional grains, if present, may include different average grain sizes, different super hard material volume densities, or both. Accordingly, a grain region of first grains may have a larger average grain size than a neighboring grain region of second grains. Alternatively or additionally, a grain region of first grains may have a greater mass of super hard material in the volume of the grain region than a neighboring grain region of second grains has in its volume.

In some embodiments wherein the property differing between grain regions is average grain size, the first average grain size, defining the first plurality of grains, may be about one-hundred-fifty (150) times smaller than the second average grain size, defining the second plurality of grains. In other embodiments, the first average grain size may be about five hundred (500) times smaller than the second average grain size. In yet other embodiments, the first average grain size may be at least about seven-hundred-fifty times smaller than the second average grain size. In other embodiments, the first average grain size may be about one-hundred-fifty (150) times smaller than the second average grain size and about five hundred (500) to about seven hundred-fifty (750) times smaller than a third average grain size, defining a third plurality of grains.

The material of the first grains, the second grains, the third grains, etc., may be the same or different materials or material mixtures. For example, the first grains may comprise or consist of diamond grains of a first property, while the second grains may comprise or consist of PCBN grains of a second property differing from the first property. As another example, the first grains may comprise a mixture of diamond and PCBN grains of a first property, while the second grains may consist of diamond of a second property different than the first property. Accordingly, while at least one of the properties (e.g., average grain size, the super hard material volume density, or both) of the different regions of grains are different from one region to another, the materials or mixtures thereof may or may not be different.

The pluralities of grains are ordered, within the table, in such a manner that grain interfaces between differing regions of grains include non-horizontally-planar interfaces, i.e., interfaces that define at least one portion having a non-zero slope relative to a horizontally planar cross-section, a horizontally planar lower or upper surface of the table, or a horizontally planar surface of a supporting substrate to which the table is adjoined. Because the grain interfaces are not merely horizontal planes, crack propagation and delamination between the grain regions may be inhibited or prohibited. In some embodiments, the grain interfaces include at least one curved portion. Therefore, the structure of ordered grain regions may provide a table for a cutting element (e.g., cutting element 20) that is less prone to structural and thermal damage than a conventional cutting element with a conventional table.

Figure 3:
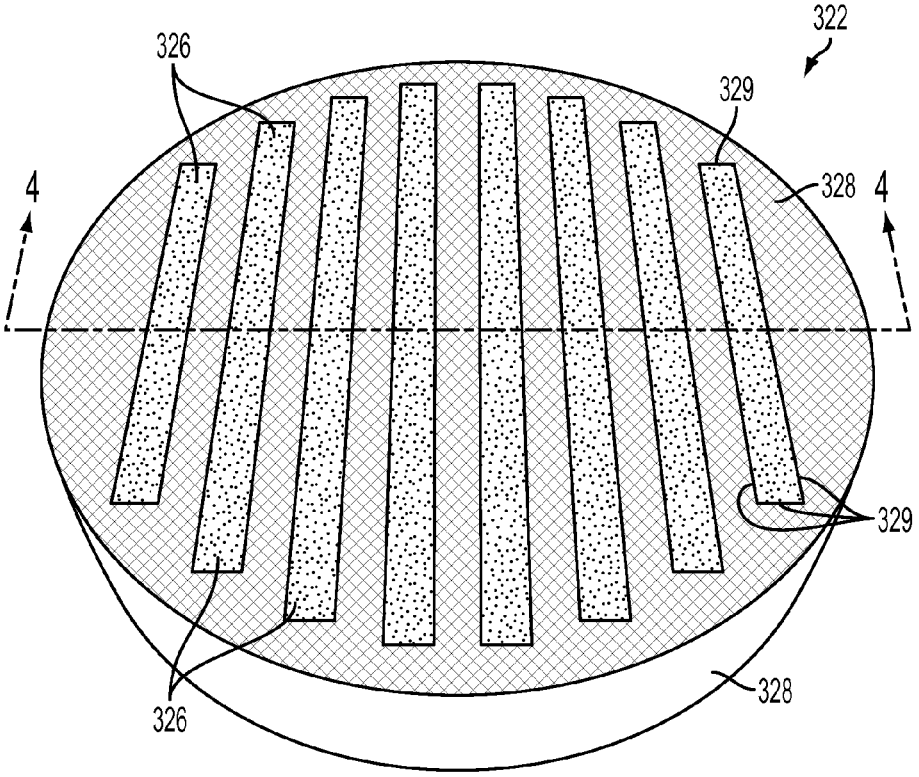
FIG. 3 is a top and front perspective view of a table according to an embodiment of the present disclosure.
Figure 4:
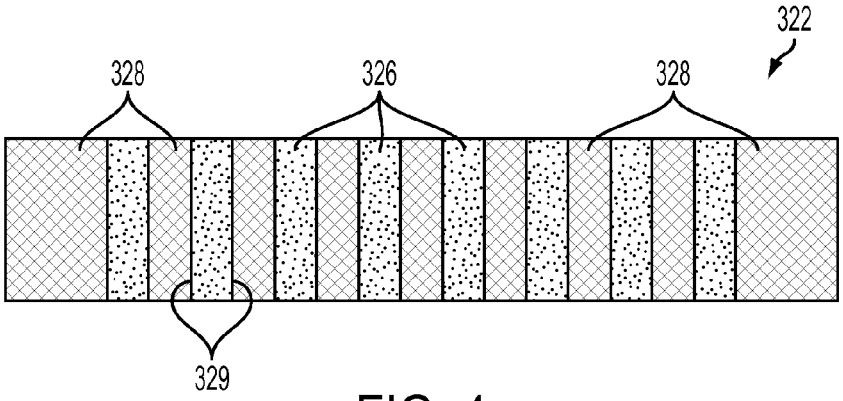
FIG. 4 is a front elevation, cross-sectional view of the table of FIG. 3, taken along vertical cross-section plane 4-4.

With reference to FIGS. 3 and 4, illustrated is an embodiment of a table 322 for a cutting element (e.g., the cutting element 20 of FIG. 2). The table 322 includes features of a first plurality of grains having a first property (e.g., average grain size, super hard material volume density, or both) referred to herein as "first grains" 326. The first grains 326 may be patterned in a series of spaced, elongate features. The regions of first grains 326 may be arranged parallel to a diameter of the table 322.

A second plurality of grains having a second property (e.g., average grain size, super hard material volume density, or both), referred to here as "second grains" 328 surround the first grains 326 in a continuous region of the second grains 328. The second grains 328 may be of a larger average grain size, a denser super hard material volume density, or both than the first grains 326. The table 322 may be structured such that the regions of the first grains 326 extend vertically through a height of the table 322, as illustrated in FIG. 4. Accordingly, each feature (i.e., elongate feature) of the first grains 326 adjoins a region of the second grains 328 at a grain interface 329 that is not horizontally planar. For example, because each feature of the first grains 326 may be surrounded on all lateral sides by a region of the second grains 328, each feature of the first grains 326 adjoins a region of the second grains 328 via a grain interface 329 comprising four vertical planar surfaces. Surrounding each feature of the first grains 326 by the second grains 328 may inhibit delamination at the grain interface 329. Further, the pattern of first grains 326 spaced by second grains 328 may inhibit propagation of cracks across a width of the table 322. Therefore, the table 322 may be less prone to delamination and crack propagation than a conventional table 322.

Figure 5:
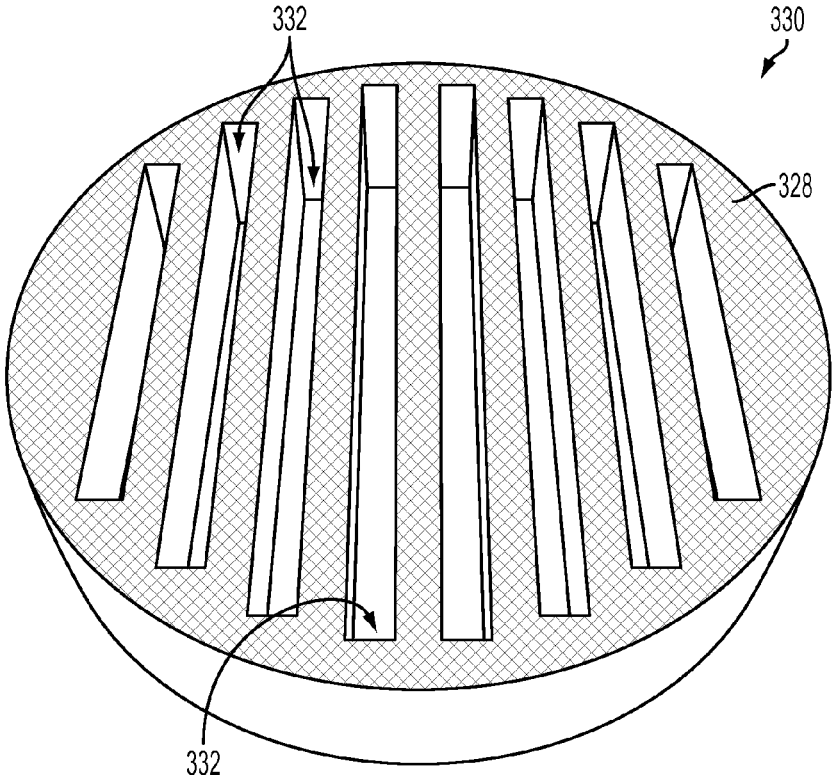
FIG. 5 is a top and front perspective view of a precursor structure for forming the table of FIG. 3.

With reference to FIG. 5, illustrated is a precursor structure 330 from which the table 322 of FIGS. 3 and 4 may be formed. The precursor structure 330 may be formed of only the second grains 328. For example, a continuous structure of the second grains 328 may be formed as shown as a "green," or unsintered body of grains mutually adhered by, for example, an organic binder. Alternatively, a green body may be formed as a disk and subsequently machined or otherwise patterned to define voids 332 extending through a height of the precursor structure 330. Accordingly, the precursor structure 330 includes an exterior surface that occupies more than one horizontal plane (i.e., has areas that are elevated or depressed relative to other areas of the exterior surface). The voids 332 (i.e., the negative space defined by the precursor structure 330) may then be filled with the first grains 326 to form the table 322 of FIG. 3. In other embodiments, first grains 326 and second grains 328 may each be formed as one or more precursor structures each comprising a green body, which precursor structures may then be assembled prior to high temperature, high pressure processing.

Figure 6:
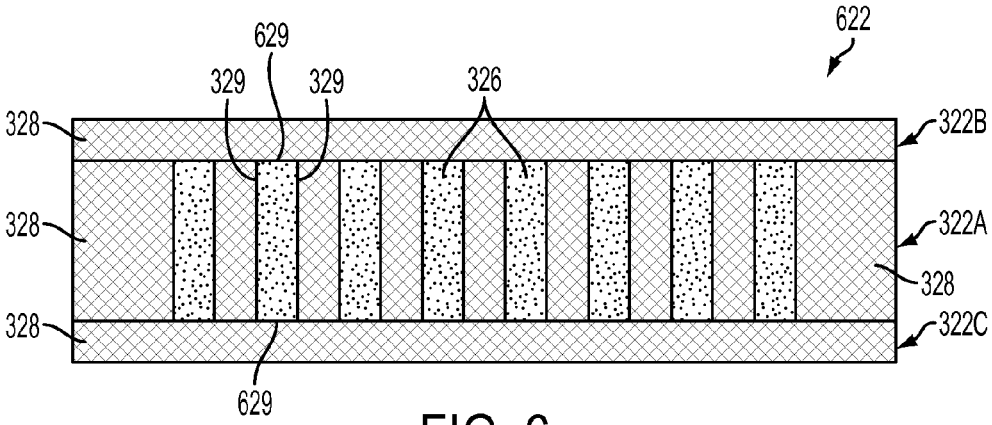
FIG. 6 is a front elevation, cross-sectional view of an alternative embodiment of the table of FIG. 3, taken from the same view as that of vertical cross-section plane 4-4.

With reference to FIG. 6, in an alternative embodiment, the table 322 of FIG. 3 may be bonded to upper and lower regions of the second grains 328 such that the structure of the table 322 is utilized as a middle region 322A of a table 622. The middle region 322A may be bonded to one or both of an upper region 322B of the second grains 328 and a lower region 322C of the second grains 328, for example, in a diamond press, to form the table 622. Thus, the features of the first grains 326 within the table 622 adjoin regions of the second grains 328 not only along the vertical grain interfaces 329, but also along upper and lower horizontal grain interfaces 629. The grain interfaces 329, 629, being structured to be not solely horizontally planar, may inhibit delamination between grain regions and inhibit crack propagation vertically and horizontally through the table 622.

It is contemplated that the different property between the first grains 326 and the second grains 328 may be different average grain size. In such embodiments, the first grains 326 of the embodiments of FIGS. 3 through 6 may have a smaller average grain size than the second grains 328 of the embodiments. However, it is also contemplated that the first grains 326 may have a larger average grain size than the second grains 328. The particular average grain sizes chosen for the first grains 326 and the second grains 328 may be selected to achieve the greatest inhibition of delamination and crack propagation of the tables 322, 622 when used in conjunction with cutting elements (e.g., cutting elements 20, the tables 322, 622 being substituted for the table 22 of FIG. 2).

In other embodiments, the different property between the first grains 326 and the second grains 328 may be different super hard material volume density. In such embodiments, the first grains 326 of the embodiments of FIGS. 3 through 6 may be of the same average grain size as the second grains 328, but with less catalyst material or with additional super hard material in interstitial spaces throughout the respective regions of the first grains 326 compared to the respective regions of the second grains 328. Thus, the regions of the first grains 326 may have a higher super hard material volume density than that of the regions of second grains 328. It is also contemplated that, in other embodiments, the regions of the second grains 328 may include less catalyst material or additional super hard material in interstitial spaces throughout the respective regions of the second grains 328 compared to the respective regions of the first grains 326. Thus, the regions of the second grains 328 may have a higher super hard material volume density than that of the regions of the first grains 326.

Figure 7:
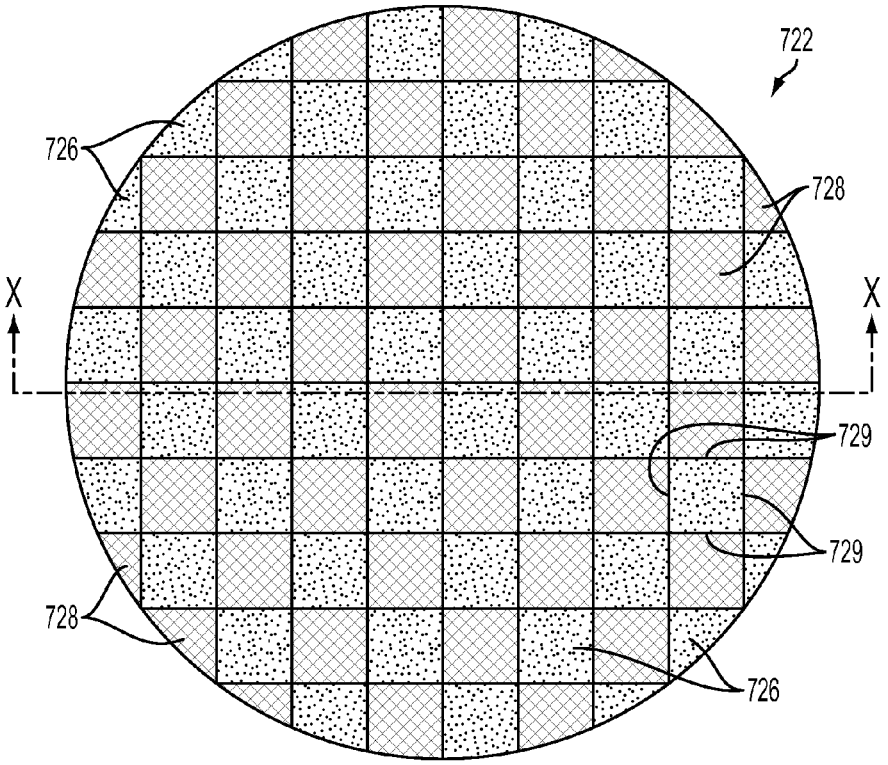
FIG. 7 is a top plan view of a table according to another embodiment of the present disclosure, wherein the table comprises grain regions of different properties, the grain regions being ordered in a square checkerboard-like pattern across a horizontal cross-section of the table.
Figure 8:
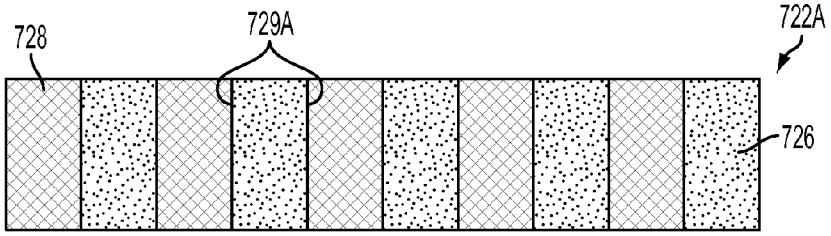
FIG. 8 is a front elevation, cross-sectional view of the table of FIG. 7, taken along vertical cross-section plane X-X, wherein the grain regions extend through a height (i.e., a vertical cross-section) of the table.

With reference to FIG. 7, illustrated is another embodiment of a table 722 comprising ordered regions of grains of different properties (e.g., different average grain sizes, different super hard material volume densities, or both), e.g., first grains 726 and second grains 728. The table 722 may be structured such that regions of the first grains 726 and regions of the second grains 728 fowl a checkerboard pattern across a width (i.e., a horizontal cross-section) of the table 722. For example, each region may define a rectangular (e.g., square) horizontal cross-section and each region of one grain (e.g., the first grains 726) may be bordered on each of its lateral sides by a region of the other grain (e.g., the second grains 728). Accordingly, grain interfaces 729 between regions of different properties are not horizontally planar but, rather, the grain interfaces 729 may be at least partially vertical.

With reference to FIGS. 8 through 13, the vertical cross-section of the table 722 may be variously structured. For example, with reference to FIG. 8, a table 722A having the top view pattern of the table 722 illustrated in FIG. 7 may have a vertical cross section illustrated in FIG. 8. As illustrated, each of the regions of the grains, i.e., the regions of the first grains 726 and the regions of the second grains 728 may be structured as blocks extending through a height of the table 722. Therefore, grain interfaces 729A between regions of different properties are vertically planar, not horizontally planar. The table 722A may thus be configured to inhibit delamination and crack propagation, e.g., through a width of the table 722A, when the table 722A is used in conjunction with a cutting element (e.g., the cutting element 20 of FIG. 2).

Figure 9:
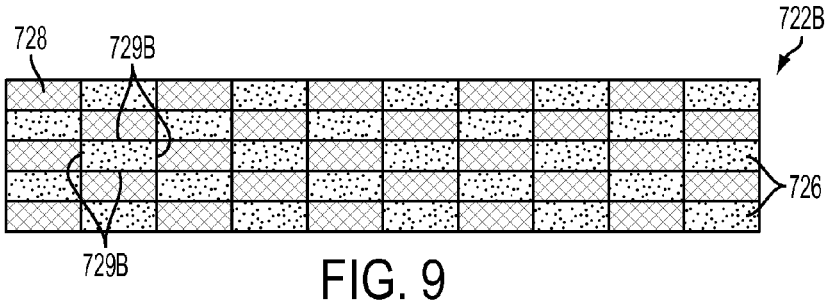
FIG. 9 is a front elevation, cross-sectional view of the table of FIG. 7, taken along vertical cross-section plane X-X, wherein the grain regions define discrete regions ordered in a checkerboard-like pattern through a vertical cross-section of the table.

With reference to FIG. 9, a table 722B having the top view pattern of the table 722 illustrated in FIG. 7 may have a vertical cross-section illustrated in FIG. 9. As illustrated, regions of grains of differing properties may also be ordered to define a checkerboard-like pattern of discrete regions repeating through a vertical cross-section of the table 722B. For example, regions of the first grains 726 may be bordered above, below, and to each lateral side by regions of the second grains 728. Accordingly, one discrete region of the first grains 726 may be disposed vertically between at least two discrete regions of the second grains 728, and/or vice versa. Therefore, grain interfaces 729B between regions of different sizes, densities, etc., include vertically planar interfaces (i.e., between laterally adjacent regions) in addition to horizontally planar interfaces (i.e., between vertically adjacent regions). The table 722B may thus be configured to inhibit delamination and crack propagation, e.g., through a width of the table 722B and through a height of the table 722B when the table 722B is used in conjunction with a cutting element (e.g., the cutting element 20 of FIG. 2).

Figure 10:
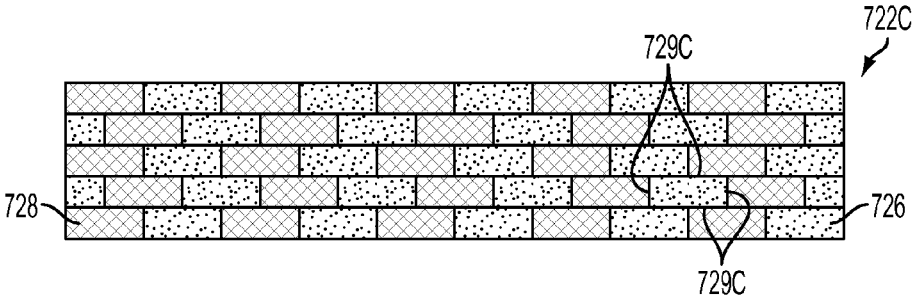
FIG. 10 is a front elevation, cross-sectional view of the table of FIG. 7, taken along vertical cross-section plane X-X, wherein discrete grain regions are also ordered in an off-set brick-like pattern through a vertical cross-section of the table.

With reference to FIG. 10, a table 722C having the top view pattern of the table 722 illustrated in FIG. 7 may have a vertical cross section illustrated in FIG. 10. As illustrated, discrete regions of grains of different properties may be ordered to define an offset brick-like pattern through a vertical cross-section of the table 722C. For example, discrete regions of the first grains 726 may be partially bordered above and below and wholly bordered on each lateral side by discrete regions of the second grains 728. In another embodiment, discrete regions of the first grains 726 are also offset to laterally adjacent discrete regions of second grains 728. Grain interfaces 729C between discrete regions of different properties include vertically planar interfaces (i.e., between laterally adjacent discrete regions) in addition to horizontally planar interfaces (i.e., between vertically adjacent discrete regions). The table 722C may thus be configured to inhibit delamination and crack propagation, e.g., through a width of the table 722C and through a height of the table 722C when the table 722C is used in conjunction with a cutting element (e.g., the cutting element 20 of FIG. 2).

Figure 11:
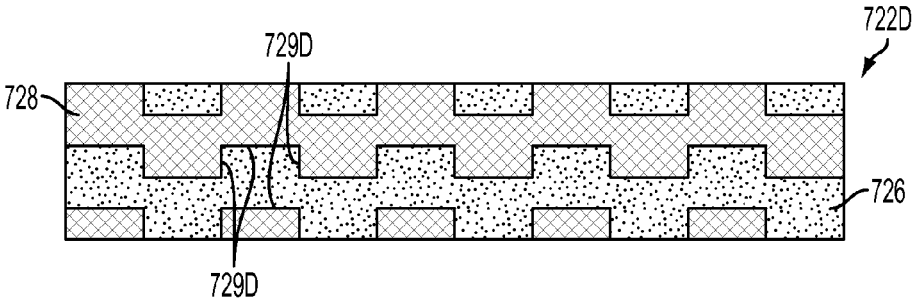
FIG. 11 is a front elevation, cross-sectional view of the table of FIG. 7, taken along vertical cross-section plane X-X, wherein the grain regions are also ordered in rectangular-waved regions repeating through a vertical cross-section of the table.

With reference to FIG. 11, a table 722D having the top view pattern of the table 722 illustrated in FIG. 7 may have a vertical cross section illustrated in FIG. 11. As illustrated, regions of grains of different properties may be ordered to define upper and lower surfaces of rectangular-waves. Thus, each rectangular-waved grain region, e.g., the regions of the first grains 726 may be bordered above and below by a correspondingly waved grain region of the second grains 728. Grain interfaces 729D between regions of different properties therefore include vertical planar surface portions (i.e., between laterally adjacent portions of the regions) in addition to horizontally planar surface portions (i.e., between vertically adjacent portions of the regions). Across a width of the table 722D, the continuous grain interfaces 729D also define the rectangular waves. The table 722D may thus be configured to inhibit delamination and crack propagation, e.g., through a width and a height of the table 722D when the table 722D is used in conjunction with a cutting element (e.g., the cutting element of FIG. 2).

Figure 12:
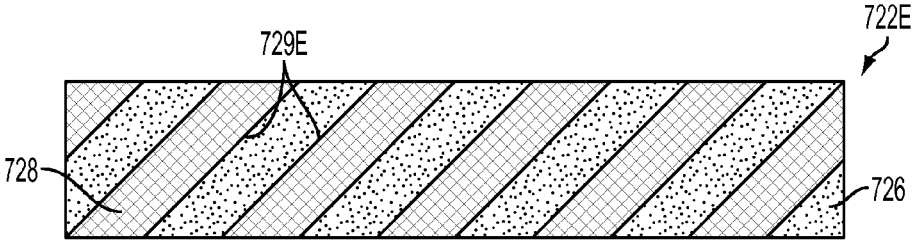
FIG. 12 is a front elevation, cross-sectional view of the table of FIG. 7, taken along vertical cross-section plane X-X, wherein the grain regions are also ordered in regions angled relative to an upper surface of the table.

With reference to FIG. 12, a table 722E having the top view pattern of the table 722 illustrated in FIG. 7 may have a vertical cross section illustrated in FIG. 12. As illustrated, regions of grains of different properties may be ordered in stacked regions, angled relative to an upper surface of the table 722E. For example, the regions may be angled at about forty-five degrees)(45° relative to the upper surface of the table 722E such that grain interfaces 729E between regions are likewise angled. Therefore, the grain interfaces 729E are not horizontally planar. It is contemplated, however, that the angle selected may be tailored to maximize performance of the table 722E. The table 722E may thus be configured to inhibit delamination and crack propagation, e.g., through a width and a height of the table 722E when the table 722E is used in conjunction with a cutting element (e.g., the cutting element 20 of FIG. 2).

Figure 13:
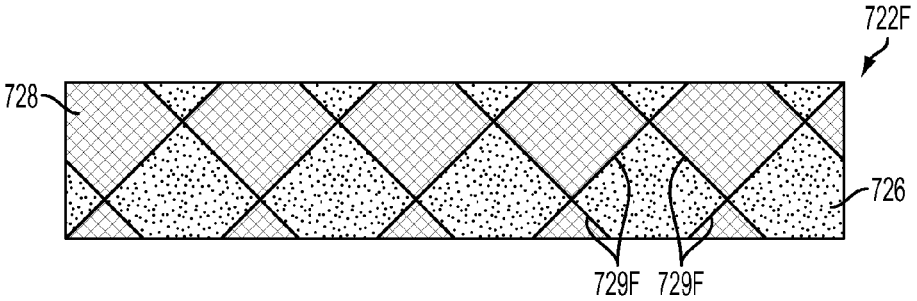
FIG. 13 is a front elevation, cross-sectional view of the table of FIG. 7, taken along vertical cross-section plane X-X, wherein the grain regions are also ordered in discrete regions defining a diamond checkerboard-like pattern repeating through a vertical cross-section of the table.

With reference to FIG. 13, a table 722F having the top view pattern of the table 722 illustrated in FIG. 7 may have a vertical cross section illustrated in FIG. 13. As illustrated, discrete regions of grains of different properties may be ordered in a diamond checkerboard-like pattern repeating through a vertical cross-section of the table 722F. For example, the discrete regions may define a parallelogram (e.g., rectangle, e.g., square) perimeter in the vertical cross-section, with the major diagonal dimension aligned perpendicular to an upper surface of the table 722F. Each discrete region of one property (e.g., average grain size, super hard material volume density, or both) of grain may be bordered on its sides by discrete regions of another property of grain. As such, grain interfaces 729F may be angled relative to the upper surface of the table 722F and are, therefore, not horizontally planar. The table 722F may thus be configured to inhibit delamination and crack propagation, e.g., through a width and a height of the table 722F when the table 722F is used in conjunction with a cutting element (e.g., the cutting element 20 of FIG. 2).

In each of the embodiments illustrated in FIGS. 7 through 13, it is contemplated that the first grains 726 may have a smaller average grain size, a greater super hard material volume density, or both than the second grains 728. However, it is also contemplated that the first grains 726 may have a larger average grain size, a lesser super hard material volume density, or both than the first grains 726. Thus, the selected average grain sizes and super hard material volume densities for the first grains 726 and the second grains 728 may be tailored to maximize the inhibition of delamination and crack propagation. Further, it is contemplated that the regions may include more than two pluralities of grains having different properties. In any regard, the embodiments include grain regions ordered in a pattern repeating across at least one of a horizontal cross-section of the table and a vertical cross-section of the table. Further, elevations (e.g., horizontal cross sections) at various heights in the tables include at least two regions of different properties such that each grain region of one property borders another grain region of another property along a grain interface that is angled, relative to the upper surface or lower surface of the table at a non-zero angle.

The structures of any of the foregoing and following tables, according to embodiments of the present disclosure, may be formed by fabricating precursor structures comprising green bodies of each of the various grain properties and then machining, molding, filling, or otherwise shaping the precursor structures into the grain regions of the ordered patterns illustrated. Those of ordinary skill in the art may utilize known methods to fabricate the structures as illustrated. Therefore, these fabrication methods are not described herein in detail other than as specified herein.

Figure 14:
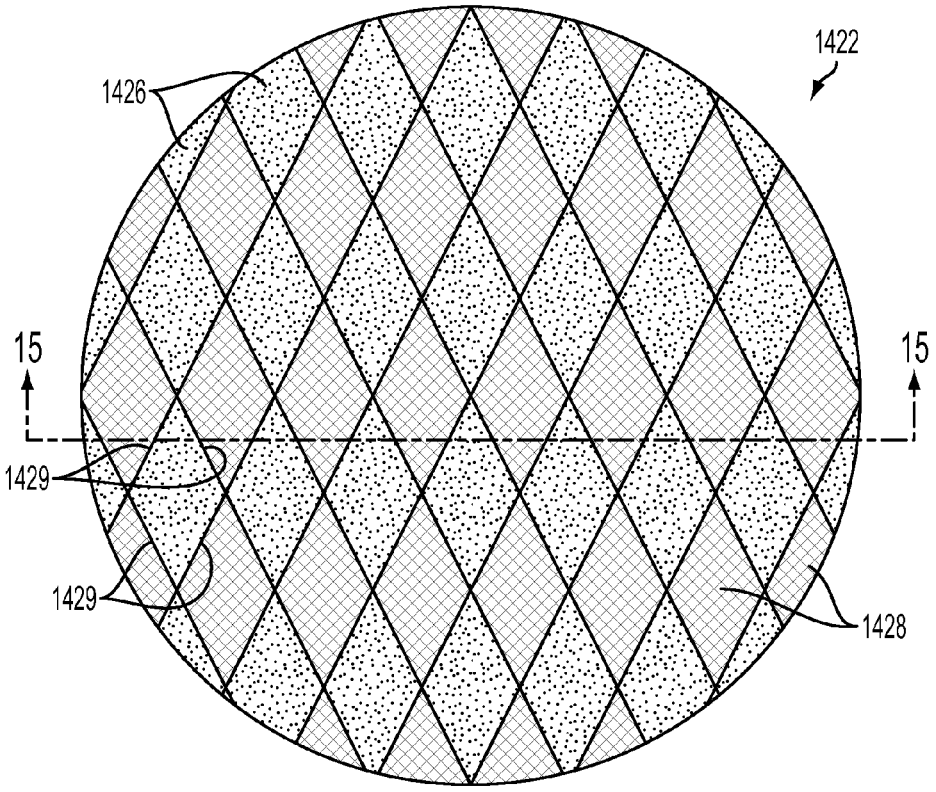
FIG. 14 is a top plan view of a table according to another embodiment of the present disclosure, wherein in the table comprises grain regions of different properties, the grain regions being ordered in a diamond checkerboard-like pattern across a horizontal cross-section of the table.
Figure 15:
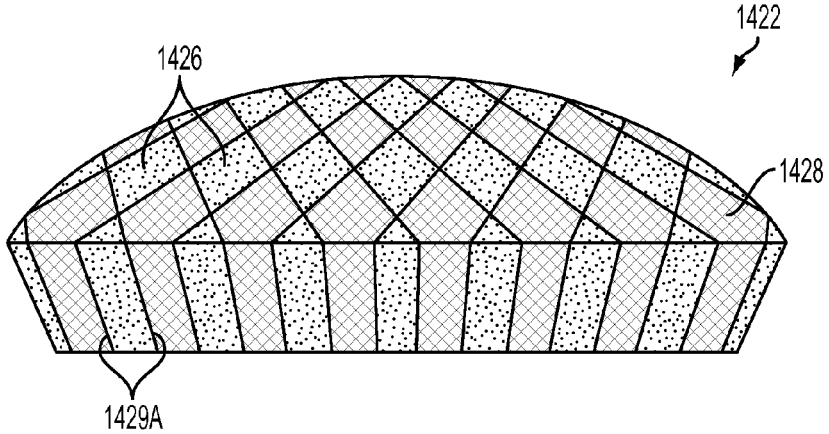
FIG. 15 is a top and front perspective view of the table of FIG. 14, taken along vertical cross-section plane 15-15.

With reference to FIGS. 14 and 15, illustrated is another embodiment of a table 1422 comprising ordered regions of grains of various properties, e.g., first grains 1426 and second grains 1428. The table 1422 may be structured such that the regions of the first grains 1426 and the regions of the second grains 1428 form a diamond checkerboard-like pattern across a width (i.e., a horizontal cross-section) of the table 1422. Each grain region may, therefore, define a feature having a parallelogram-shaped outer perimeter in a horizontal plane, which shape may include acute angles of about 45° to about 30°. It is contemplated that the angles and orientations of the diamonds may be selected to tailor the table 1422 to maximize inhibition of delamination and crack propagation.

Each grain region of one property may laterally adjoin other grain regions of another property defining grain interfaces 1429 therebetween. The grain interfaces 1429 may include non-horizontally-planar interface portions, e.g., vertical grain interfaces 1429A, as illustrated in FIG. 15. For example, each grain region may extend a height of the table 1422, defining the vertical grain interfaces 1429A along each sidewall of the grain region. It is contemplated, however, that the vertical cross section may be variously structured, e.g., as illustrated in the embodiments of FIGS. 9 through 13.

Figure 16:
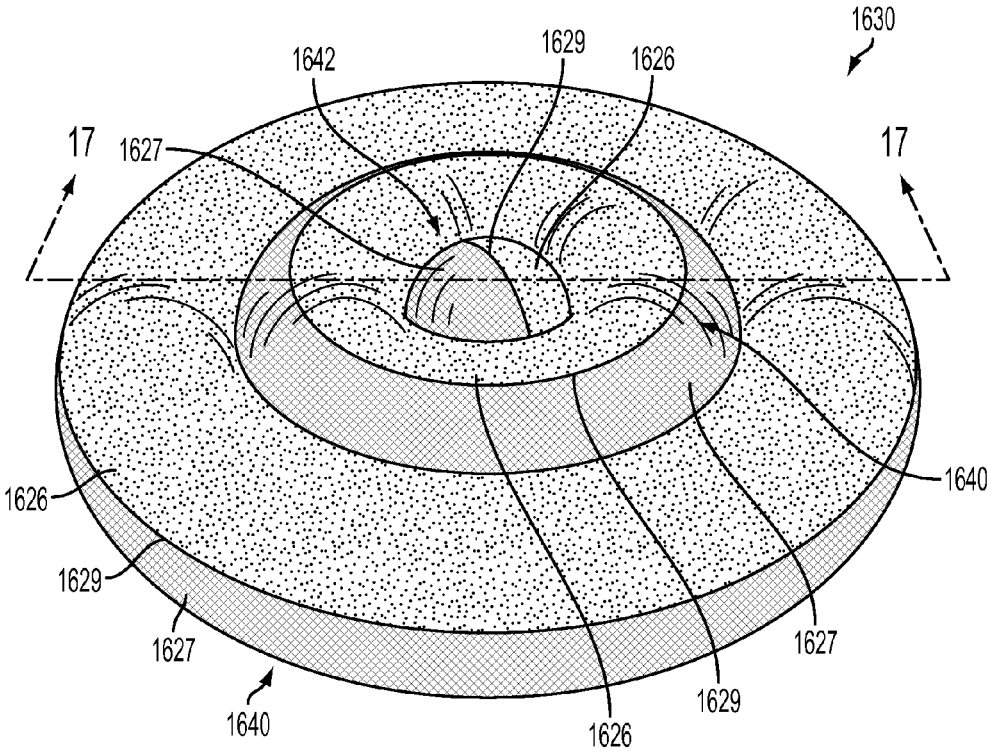
FIG. 16 is a top and front perspective view of a precursor structure for forming a table according to another embodiment of the present disclosure, wherein grain regions are structured in toroids with multi-layer spiral cross sections.
Figure 17:
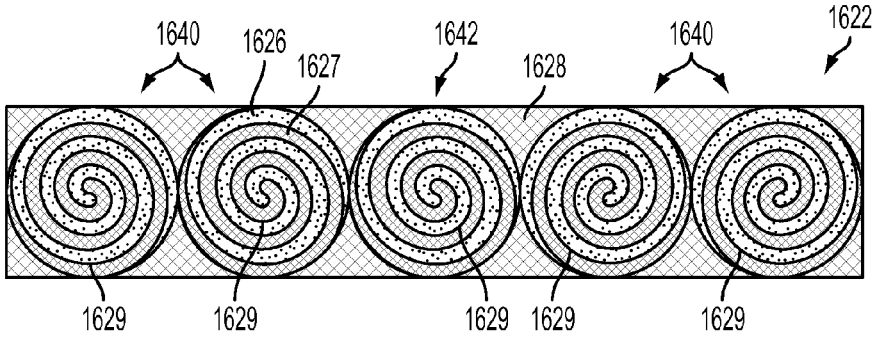
FIG. 17 is a front elevation, cross-sectional view of a table formed from the precursor structure of FIG. 16, taken along vertical cross-section plane 17-17.

The regions of grains within tables according to the present disclosure may also include non-planar grain interfaces. For example, with reference to FIGS. 16 and 17, illustrated is a table 1622 (FIG. 17) formed from a precursor structure 1630 in which regions of first grains 1626 and regions of second grains 1627 are structured in toroids 1640 and, optionally, a central sphere 1642, in which the vertical cross-section defines a multi-layer spiral, as illustrated in FIG. 17. Accordingly, the precursor structure 1630 includes an exterior surface that occupies more than one horizontal plane (i.e., has areas that are elevated or depressed relative to other areas of the exterior surface).

The toroids may be formed by overlapping a layer of the first grains 1626 with a layer of the second grains 1627 and then rolling the layers together into a cylindrical structure, having the multi-layer spiral vertical cross section. The cylindrical structure may then be molded or otherwise shaped into the toroids 1640. A similar process may be used to shape the central sphere 1642 from a rolled structure of the first grains 1626 and the second grains 1627 so as to form the central sphere 1642 with the multi-layer spiral vertical cross-section illustrated in FIG. 17. The toroids 1640 and the central sphere 1642, if present, may be arranged as illustrated in FIG. 16, i.e., with the central sphere 1642 occupying the center of a width of the precursor structure 1630, a toroid 1640 encircling the central sphere 1642, and another toroid 1640 encircling the other toroid 1640.

The grain regions of the toroids 1640 and the central sphere 1642 therefore adjoin one another along grain interfaces 1629 that are not horizontally planar. Moreover, the grain interfaces 1629 are not planar. Rather, the grain interfaces 1629 are curved. For example, as illustrated in FIG. 17, the grain interfaces 1629 define curved portions along a vertical cross-section of the table 1622. As illustrated in FIG. 16, the grain interfaces 1629 may define curved portions along a horizontal cross-section of the table 1622 as well. The grain interfaces 1629 may define no planar portions such that the grain interfaces 1629 may be wholly curved. The curved nature of the grain interfaces 1629 may deflect crack propagation from traveling in an essentially straight trajectory. After all, because a straight line is the shortest distance between two points, a crack that is able to propagate through a table with a straight trajectory may faster achieve a greater amount of structural damage than a crack that is deflected from such straight trajectory.

A third plurality of grains of another property (i.e., a third average grain size, a third super hard material volume density, or both), e.g., third grains 1628, may then fill space between the toroids 1640 and the central sphere 1642 (i.e., the negative space defined by the precursor structure 1630) to fill, for example, a cylindrical shape and form the table 1622. The table 1622 may thus be configured to inhibit delamination and crack propagation, e.g., through a width and a height of the table 1622 when the table 1622 is used in conjunction with a cutting element (e.g., the cutting element 20 of FIG. 2).

It is contemplated that the first grains 1626 may be of a smaller average grain size than the second grains 1627, a greater super hard material volume density than the region of the second grains 1627, or both. The second grains 1627 may be of a smaller average grain size, a greater super hard material volume density, or both, than the third grains 1628. However, it is also contemplated that the first grains 1626, second grains 1627, and third grains 1628 may be of different relative average grain sizes, super hard material volume densities, or both. Moreover, in some embodiments, the filler grains may be additional amounts of the first grains 1626 or the second grains 1627 rather than a different size of grains or a region of a different super hard material volume density (i.e., the third grains 1628). The selected average grain size and super hard material volume density for each of the grain regions may, therefore, be tailored to achieve the maximum inhibition of delamination and crack propagation.

Figure 18:
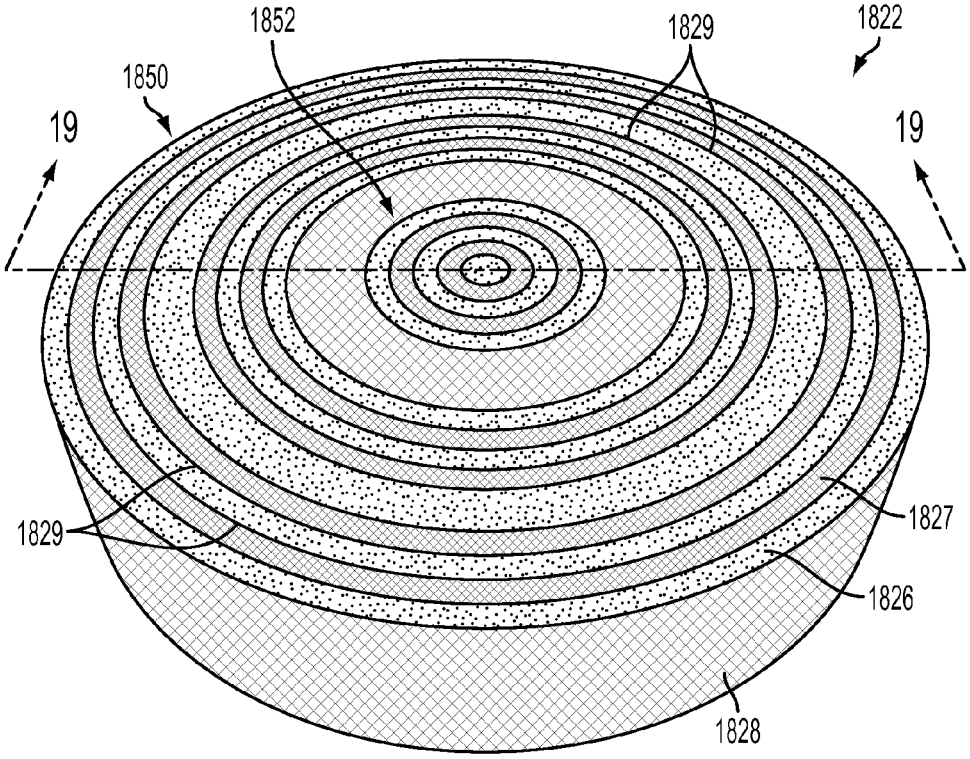
FIG. 18 is a top and front perspective view of a table according to another embodiment of the present disclosure, wherein the table comprises grain regions of different properties, the grain regions being ordered in partially-overlapping concentric partial toroids.
Figure 19:
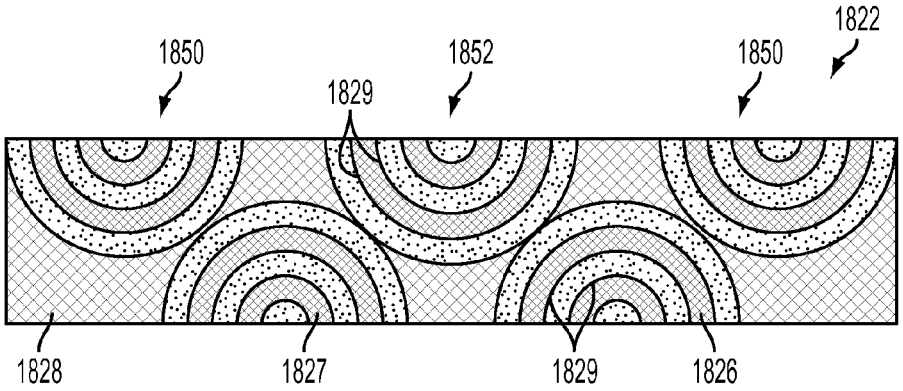
FIG. 19 is a front elevation, cross-sectional view of the table of FIG. 18, taken along vertical cross-section plane 19-19.

With reference to FIGS. 18 and 19, illustrated is another embodiment of a table 1822 comprising ordered regions of grains of various properties, e.g., first grains 1826, second grains 1827, and third grains 1828. The first grains 1826 and second grains 1827 may be structured in concentric partial toroids 1850 (e.g., concentric toroids having semi-circle vertical cross sections) and, optionally, a concentric partial sphere 1852 (e.g., concentric hemispheres). The grain regions within each of the concentric partial toroids 1850 and the concentric partial sphere 1852 may define strata within each of the structures. For example, at the core of each concentric partial toroid 1850 may be a partial toroid of the first grains 1826, which may be surrounded by a region of the second grains 1827, which may be surrounded by a region of the first grains 1826, and so on, alternating, through the cross-sectional diameter of the concentric partial toroid 1850. Likewise for the concentric partial sphere 1852, as illustrated in FIGS. 18 and 19. Thus, the grain regions may define grain interfaces 1829 that are non-horizontally-planar and, moreover, wholly non-planar (i.e., wholly curved). Therefore, the grain interfaces 1829 may include curved portions in at least one of a horizontal cross-section (FIG. 18) and a vertical cross-section (FIG. 19).

The curved exterior of each of the concentric partial toroids 1850 and the concentric partial sphere 1852 may be disposed inward of an exterior surface of the table 1822, as illustrated in FIG. 19. Accordingly, each stratum grain region within the concentric partial toroids 1850 and the concentric partial sphere 1852 may be exposed at a surface of the table 1822. Further, the concentric partial toroids 1850 and the concentric partial sphere 1852 may be arranged to at least partially vertically overlap one another, as illustrated in FIG. 19.

The third grains 1828 may fill otherwise void or negative space to define an essentially cylindrical shape of the table 1822. The table 1822 may thus be configured to inhibit delamination and crack propagation, e.g., through a width and a height of the table 1822 when the table 1822 is used in conjunction with a cutting element (e.g., the cutting element 20 of FIG. 2).

It is contemplated that the first grains 1826 may be of a smaller average grain size, a greater super hard material volume density, or both than the second grains 1827 and that the second grains 1827 may be of a smaller average grain size, a greater super hard material volume density, or both than the third grains 1828. However, it is also contemplated that the first grains 1826, second grains 1827, and third grains 1828 may be of different relative properties. Moreover, in some embodiments, the filler grains may be additional amounts of the first grains 1826 or the second grains 1827 rather than a grain region of a different property (i.e., the third grains 1828). The selected average grain size and the super hard material volume density for each of the grain regions may, therefore, be tailored to achieve the maximum inhibition of delamination and crack propagation.

Figure 20:
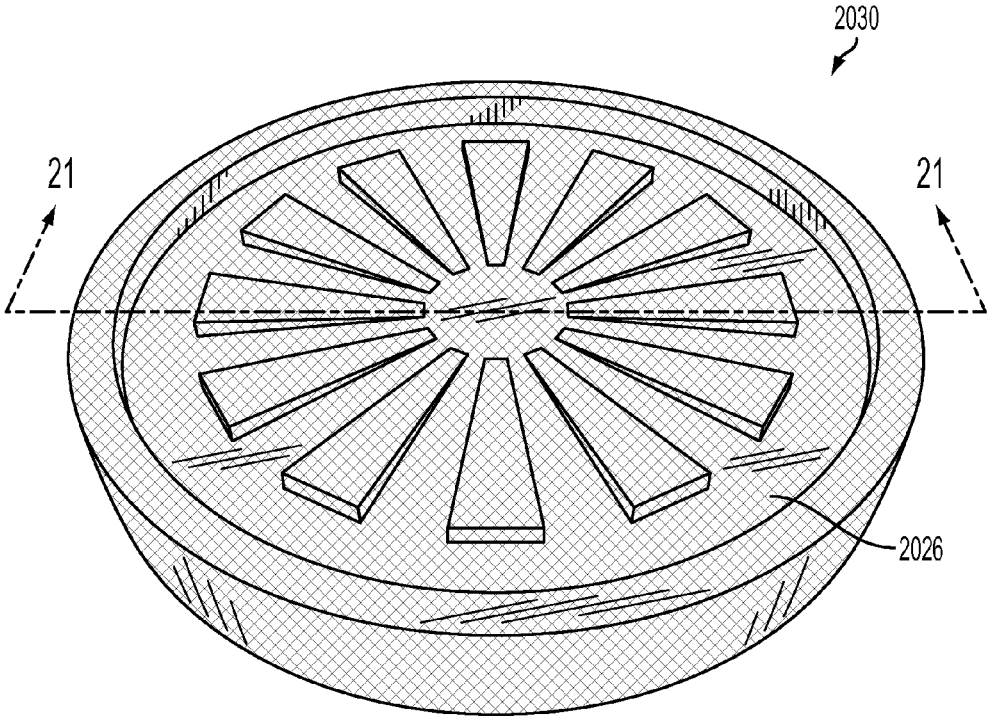
FIG. 20 is a top and front perspective view of a precursor structure for forming a table according to another embodiment of the present disclosure, wherein grains of one property define a relief structure to be filled by grains of another property.
Figure 21:
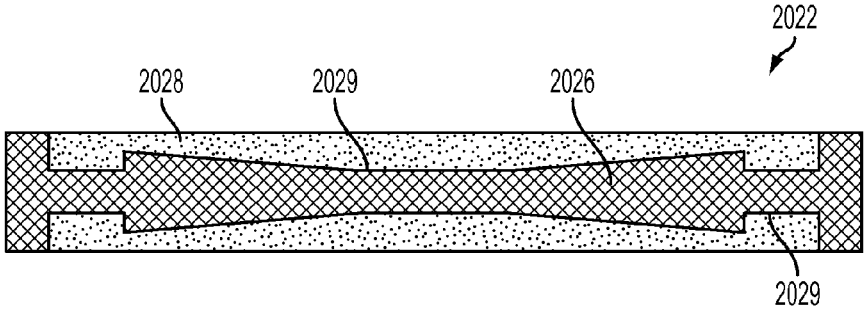
FIG. 21 is a front elevation, cross-sectional view of a table formed from the precursor structure of FIG. 20, taken along vertical cross-section plane 21-21.

With reference to FIGS. 20 and 21, illustrated is another embodiment of a table 2022 (FIG. 21) according to an embodiment of the present disclosure. Grains of one property, e.g., first grains 2026, may be fabricated to define a precursor structure 2030 having a three-dimensional structure, such as a relief structure of radiating wedges tapering downward in elevation from a maximum elevation proximate to a periphery of the horizontal cross section of the precursor structure 2030 toward a minimum elevation proximate to a center of the horizontal cross section of the precursor structure 2030. A relief structure may be defined in both an upper and a lower surface of the precursor structure 2030, as illustrated in FIG. 21, or, alternatively, in only one surface. As illustrated in FIG. 21, an upper surface of the precursor structure 2030 may define a relief structure that is a mirror image of a relief structure defined by a lower surface of the precursor structure 2030. The precursor structure 2030 includes an exterior surface that occupies more than one horizontal plane (i.e., has areas that are elevated or depressed relative to other areas of the exterior surface).

Negative space of the precursor structure 2030 may then be filled with grains of at least one other property, e.g., second grains 2028. Thus, the resulting table 2022 may have a substantially cylindrical shape with multiple grain regions of different properties therein wherein grains of one region, e.g., the first grains 2026, adjoin a region of another grain property, e.g., the second grains 2028, along a grain interface 2029 that is not horizontally planar. Rather, the grain interface 2029 may include angled portions and vertical portions in addition to horizontal portions.

Though one relief structure is illustrated in FIGS. 20 and 21, it is contemplated that the relief structure may be altered to provide any relief structure that defines a non-horizontally planar grain interface 2029 between the first grains 2026 and the second grains 2028. Further, additional regions of grains of different properties may be included either in the precursor structure 2030 or to fill the negative space defined by the precursor structure 2030.

While it is contemplated that the average grain size of the first grains 2026 may be larger than the average grain size of the second grains 2028, or that the super hard material volume density of the regions of first grains 2026 may be lesser than the super hard material volume density of the regions of second grains 2028, or both, it is also contemplated that the relative properties of the first grains 2026 and the second grains 2028 may be reversed or otherwise altered. Thus, the selected average grain sizes and the super hard material volume densities of the grain regions may be selected to tailor the table 2022 to achieve maximum inhibition of delamination and crack propagation. In any regard, the table 2022 may be configured to inhibit delamination and crack propagation, e.g., through a width and a height of the table 2022 when the table 2022 is used in conjunction with a cutting element (e.g., the cutting element 20 of FIG. 2).

Figure 22:
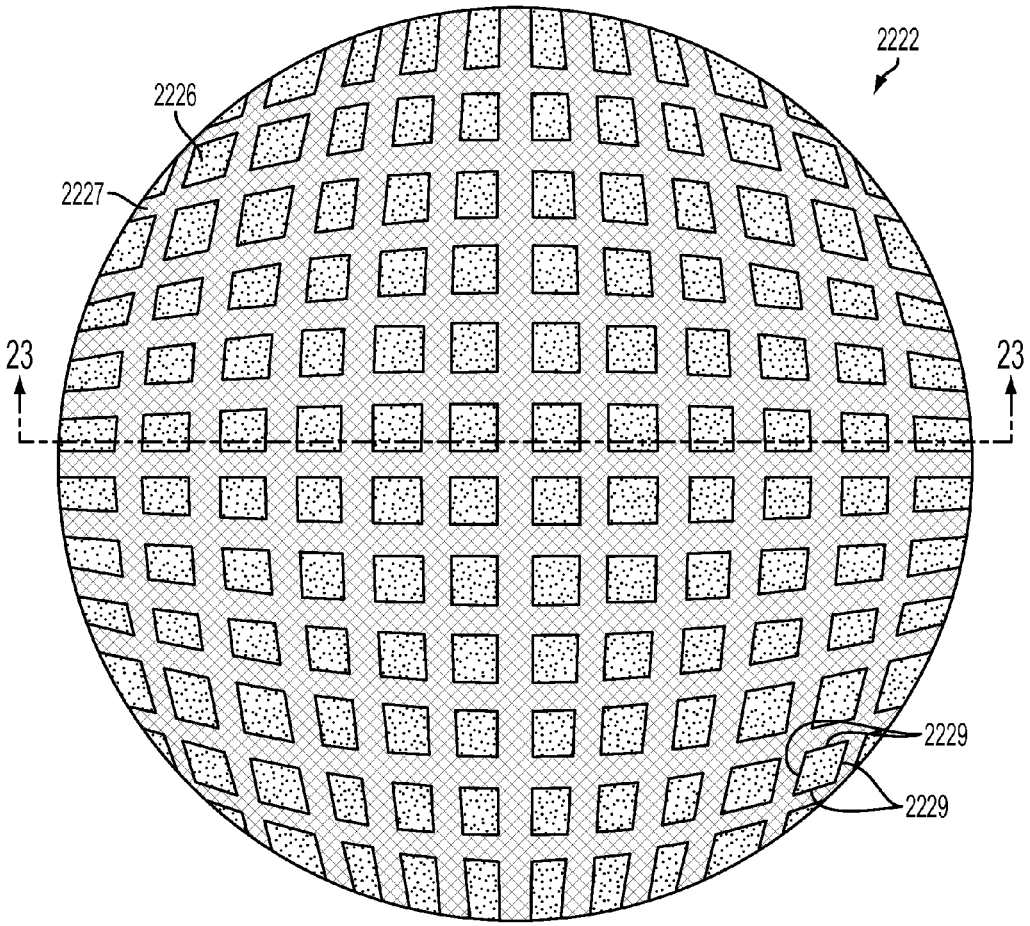
FIG. 22 is a top plan view of a table according to another embodiment of the present disclosure, wherein grains of one property define a domed grate-like pattern and grains of another property define discrete features filling the domed grate-like pattern.
Figure 23:
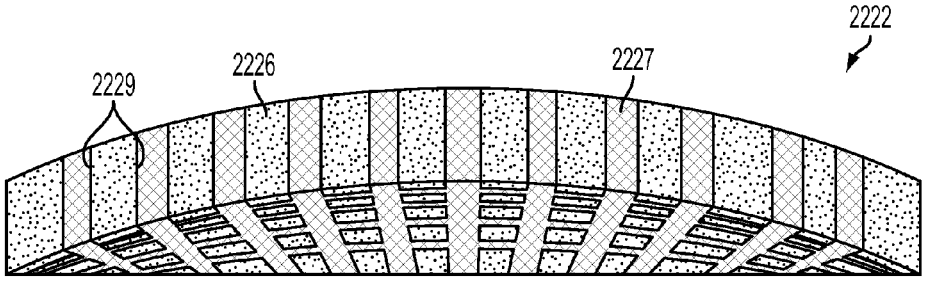
FIG. 23 is a front elevation, cross-sectional view of the table of FIG. 22, taken along vertical cross-section plane 23-23.

With reference to FIGS. 22 and 23, illustrated is another embodiment of a table 2222 wherein regions of different properties, e.g., first grains 2226 and second grains 2227, are ordered to define non-horizontally-planar grain interfaces 2229 (e.g., vertically-planar grain interfaces 2229) between different regions. According to the embodiment of FIGS. 22 and 23, a precursor structure of one grain property, e.g., the second grains 2227, may be structured in a domed grate, and voids of the domed grate may be filled with grains of another grain property, e.g., the first grains 2226, to provide a plurality of discrete features of the first grains 2226 spaced from one another by the second grains 2227. Each of the discrete features of the first grains 2226 may extend a height of the domed grate table 2222, which defines both a curved (domed) upper surface and a curve (domed) lower surface. The table 2222 may thus be configured to inhibit delamination and crack propagation through, e.g., a width, of the table 2222.

Figure 24:
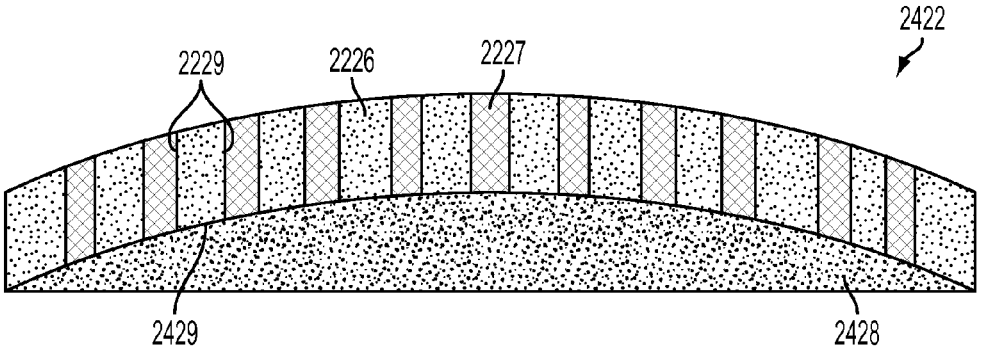
FIG. 24 is a front elevation, cross-sectional view of a table according to another embodiment of the present disclosure, wherein the table includes the structure of FIG. 22 with an under-fill of grains of still another property, taken along the same view as vertical cross-section plane 23-23.

With reference to FIG. 24, in some embodiments, the table 2222 of FIGS. 22 and 23 may be underfilled with additional grains of super hard material, e.g., grains of a third property, e.g., third grains 2428. Accordingly, the domed structure of discrete regions of the first grains 2226 spaced by the second grains 2227 may be underfilled with third grains 2428 to define a flat lower surface of the table 2422 with a domed upper surface. Such a table 2422 therefore includes not only the non-horizontally planar grain interfaces 2229 (e.g., vertical grain interfaces 2229) between the first grains 2226 and the second grains 2227, but also includes a non-planar grain interface 2429 (e.g., a domed grain interface 2429) between the third grains 2428 and each of the first grains 2226 and the second grains 2227. Thus, regions of the first grains 2226 and regions of the second grains 2227 may define portions of the curved grain interface 2429, which, as illustrated in FIG. 24, may be curved through a vertical cross-section of the table 2422. Again, such table 2422 may be configured to inhibit delamination and crack propagation through (e.g., a width and a height of) the table 2422 when the table 2422 is used in conjunction with a cutting element (e.g., cutting element 20 of FIG. 2). That is, a supporting substrate 2524 may be adjoined to the table 2422, forming an interface 2523 between the table 2422 and the supporting substrate 2524 to fault a cutting element 2520, as illustrated in FIG. 25.

Accordingly, disclosed are tables (e.g., 322 (FIGS. 3 and 4), 622 (FIG. 6), 722 through 722F (FIGS. 7 through 13), 1422 (FIGS. 14 and 15), 1622 (FIG. 17), 1822 (FIGS. 18 and 19), 2022 (FIG. 21), 2222 (FIGS. 22 and 23), and 2422 (FIG. 24)) comprising ordered regions of grains of different properties such as different average grain sizes, different super hard material volume densities, or both. Grain interfaces between the ordered regions include non-horizontally planar interfaces. Rather, the grain interfaces include grain interfaces having at least one portion that defines a slope (relative to a width of the supporting substrate) that is greater than zero degrees. (For reference, a horizontally planar interface is defined herein to have a consistent slope of zero degrees across a width of the table.) Further, at least one elevation (i.e., at least one horizontal plane) along a height of the table is occupied by more than one grain region, such that at least one elevation comprises at least two pluralities of grains having differing properties with the pluralities ordered in distinct regions (i.e., not merely intermixed). The grain interfaces may include curved portions through a vertical cross-section of the tables, and the regions of grains may be arranged in ordered patterns that repeat across a horizontal cross-section and/or a vertical cross-section. This structure of ordered grain regions may inhibit delamination and crack propagation when any of the tables are used in cutting elements.

Figure 25:
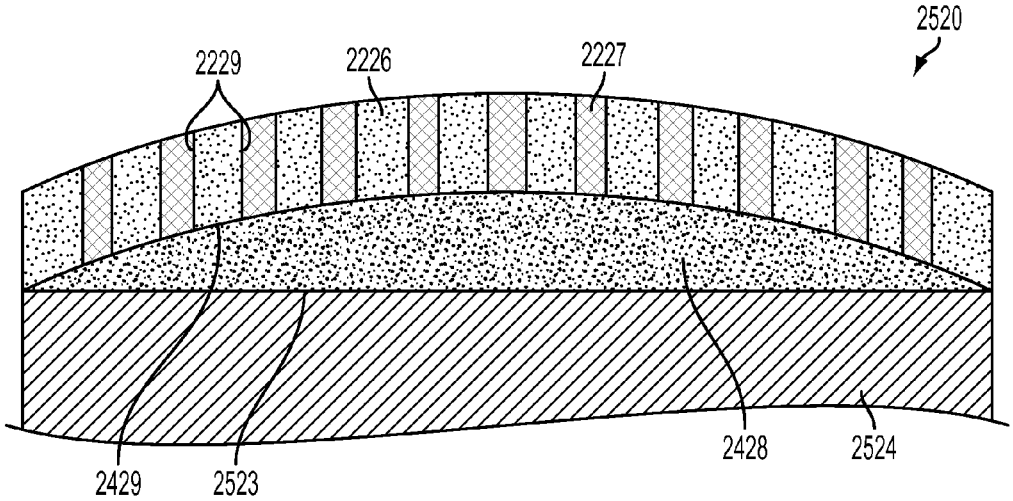
FIG. 25 is a front elevation, cross-sectional, partial view of a cutting element including the table of FIG. 24, taken along the same view as vertical cross-section plane 23-23.

Any of the tables (622, 722 through 722F, 1422, 1622, 1822, 2022, 2222, and 2422) disclosed herein may be adjoined to a supporting substrate (e.g., the supporting substrate 24 of FIG. 2 or 2524 of FIG. 25), for example, using an HPHT process, to form a cutting element (e.g., cutting element 20 of FIG. 2 or 2520 of FIG. 25). The HPHT process may form inter-granular bonds between the grains within each region of the ordered table structure (e.g., inter-granularly bonding the first grains and inter-granularly bonding the second grains). The HPHT process may also form inter-granular bonds between grains of neighboring regions, i.e., across grain interfaces. (e.g., inter-granularly bonding the first grains with the second grains).

Figure 26:
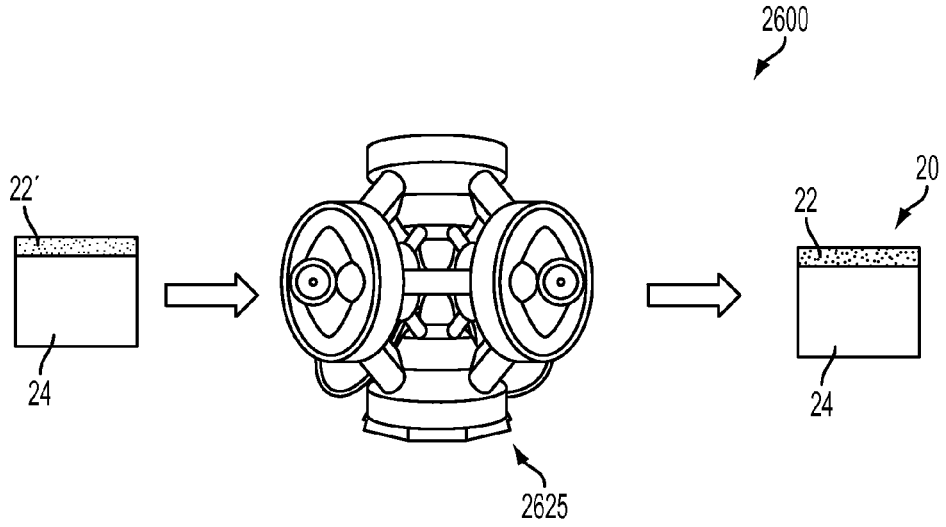
FIG. 26 is a simplified process flow illustration of a one-step HPHT process for forming a cutting element according to an embodiment of the present disclosure.
Figure 27:
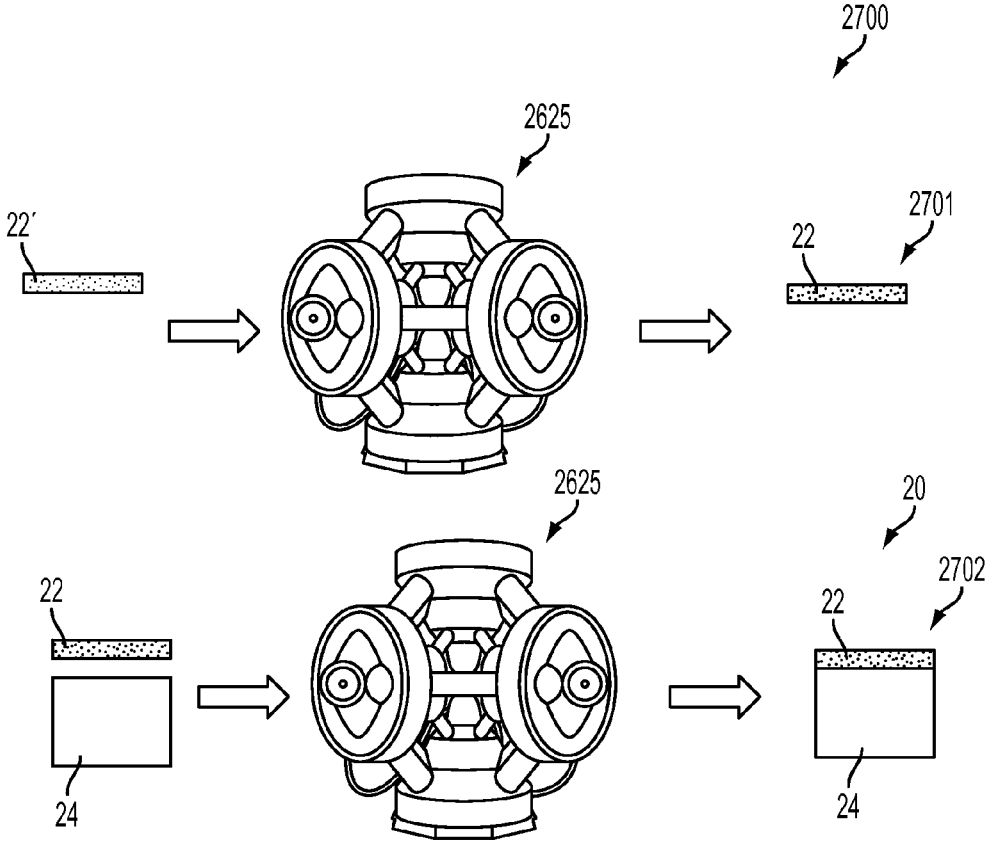
FIG. 27 is a simplified process flow illustration of a two-step HPHT process for forming a cutting element according to an embodiment of the present disclosure.

With reference to FIGS. 26 and 27, often, inter-granular bonds form when the components of a cutting element 20 are compressed during production in a HPHT process (i.e., a sintering process). A catalyst material, which may initially be in a powdered form, may be interspersed with the grains of super hard material, i.e., in any or all of the grain regions, prior to sintering the grains together in the HPHT process. Alternatively or additionally, in embodiments in which the table 22 is fowled on a supporting substrate 24 that includes a catalyst material such as cobalt or another Group VIII element or alloy thereof, the cobalt, or other such material, from the supporting substrate 24 may be swept into the grains of super hard material during the HPHT process (i.e., the sintering process) and may serve as the catalyst material for forming inter-granular bonds between the grains of super hard material. For example, cobalt from the supporting substrate 24 may be swept into overlying ordered regions of diamond grains, ordered in regions of varying grain properties, and the cobalt may catalyze formation of diamond-to-diamond bonds within each of the ordered regions and between the ordered regions. Thus, the formed table 22 with ordered regions include inter-granularly bonded grains of super hard material.

Some HPHT processes may further include use of nano-additives in the table 22 to be formed. Such nano-additives may function as nucleation sources, encouraging formation of inter-granular bonds. U.S. patent application Ser. No. 12/852,313, filed Aug. 6, 2010, published Feb. 10, 2011, as U.S. Patent Application Publication 2011/0031034, entitled "Polycrystalline Compacts Including In-Situ Nucleated Grains, Earth-Boring Tools Including Such Compacts, and Methods of Forming Such Compacts and Tools," the disclosure of which is hereby incorporated by reference in its entirety, describes some such methods using nano-additives.

FIGS. 26 and 27 illustrated one- and two-step HPHT processes for forming cutting elements 20 including the tables 22 supported by the supporting substrates 24 utilizing a super-hard-material feed 22' and the supporting substrate 24 that are bonded together in a press 2625. Any of the foregoing described structures for tables (e.g., 322 (FIGS. 3 and 4), 622 (FIG. 6), 722 through 722F (FIGS. 7 through 13), 1422 (FIGS. 14 and 15), 1622 (FIG. 17), 1822 (FIGS. 18 and 19), 2022 (FIG. 21), 2222 (FIGS. 22 and 23), and 2422 (FIG. 24)) may be the structure of either or both of the super-hard-material feed 22' or table 22 of FIGS. 26 and 27. Thus, any of the foregoing table structures (e.g., illustrated in FIGS. 3, 4, 6 through 15, 17 through 19, and 21 through 24) may be substituted for the super-hard-material feed 22' of FIGS. 26 and 27. In such case, the sintered table, following the HPHT process utilizing the press 2625 may have a more compact structure, but it is contemplated that the finale, sintered table still includes ordered regions of grains of different properties with non-horizontally planar grain interfaces. Alternatively, any of the foregoing table structures (e.g., illustrated in FIGS. 3, 4, 6 through 15, 17 through 19, and 21 through 24) may be the structure of the final table (e.g., table 22) after the HPHT process utilizing the press 2625. For ease of discussion, however, the following discussion of FIGS. 26 and 27 refers simply to the super-hard-material feed 22', the table 22, etc., without specifying, at each use, that the aforementioned tables (of FIGS. 3, 4, 6 through 15, 17 through 19, and 21 through 24) may be substituted therefor.

As illustrated in FIG. 26, embodiments of the present disclosure may include forming cutting elements 20 by forming the table 22 of polycrystalline material on the supporting substrate 24. This process is referred to herein as a "one-step HPHT process" 2600. Alternatively, as illustrated in FIG. 27, embodiments of the present disclosure may include forming cutting elements 20 by forming the table 22 of polycrystalline material first and then attaching the table 22 to the supporting substrate 24. This process is referred to herein as a "two-step HPHT process" 2700.

According to a one-step HPHT process 2600, the super-hard-material feed 22' (e.g., a diamond feed or other super hard material crystal feed, including non-inter-bonded super hard material grains (or crystals)), to be included in the table 22 to be formed, and the supporting substrate 24 are subjected to the press 2625. Grains of the super-hard-material feed 22' may be ordered in the structures discussed above when subjected to the press 2625. In some embodiments, the grains of the super-hard-material feed 22' are loosely ordered, and become more tightly ordered as a result of the one-step HPHT process 2600. In some embodiments, some of the grains of the super-hard-material feed 22' may have been pre-sintered into a polycrystalline structure, while other grains comprise a powder of grains.

In some embodiments of the one-step HPHT process 2600, nano-level precipitates of catalyst may have also been included in the super-hard-material feed 22' for the formation of the table 22. Methods of adding extremely well dispersed catalyst amongst the ordered grains of the super-hard-material feed 22' may be utilized to form the table 22 of polycrystalline material. Catalyst may, alternatively or additionally, be included in the supporting substrate 24 before it is subjected to the press 2625.

The press 2625 is illustrated as a cubic press. Alternatively, the process may be performed using a belt press or a toroid press. In the press 2625, the super-hard-material feed 22' and the supporting substrate 24 are subjected to elevated pressures and temperatures to form the polycrystalline material of a polycrystalline compact structure (i.e., the table 22). The resulting, compressed article, i.e., the cutting element 20, includes the table 22 of ordered, inter-granularly bonded grains of super hard material, with the table 22 connected to the supporting substrate 24.

The two-step HPHT process 2700 of FIG. 27 may be utilized as an alternative to the one-step HPHT process 2600 of FIG. 26. As illustrated, the super-hard-material feed 22' of grains of super hard material is subjected to HPHT conditions in the press 2625 during a first stage 2701 of the two-step HPHT process 2700 corresponding to the single stage described above with respect to the one-step process, with or without the presence of a supporting substrate 24, which if present may be subsequently removed as known to those of ordinary skill in the art. In the press 2625, the super-hard-material feed 22' is subjected to elevated pressures and temperatures, the result of which is the formation of the polycrystalline material table 22 with ordered inter-granularly bonded grains of super hard material. The table 22 and a supporting substrate 24 are then both subjected, together, to the press 2625 during a second stage 2702 of the two-step HPHT process 2700, to form the cutting element 20, which includes the table 22 of the ordered grain regions of polycrystalline material atop and bonded to the supporting substrate 24 along the interface 23 (FIG. 2).

The second stage 2702 of FIG. 27 may be utilized with a previously sintered table 22 of polycrystalline material to bond the previously sintered table 22 of polycrystalline material to the supporting substrate 24.

In the two-step HPHT process 2700, an original supporting substrate 24 used to form table 22 and the new supporting substrate 24 incorporated in cutting element 20 may have the same or similar compositions. Furthermore, leaching may optionally be carried out before or after the second stage 2702. That is, a previously sintered table 22, either before re-attachment to the supporting substrate 24 or after the re-attachment, may, optionally, be subjected to a leaching process, as discussed in further detail below. The leaching process may remove some or substantially all of catalyst material from interstitial spaces between inter-bonded grains using, for example, an acid leaching process. For example, one or more of the leaching processes described in U.S. Pat. No. 4,224,380, issued Sep. 23, 1980; U.S. Pat. No. 5,127,923, issued Jul. 7, 1992; and U.S. Pat. No. 8,191,658, issued Jun. 5, 2012, the disclosures of each of which are incorporated herein by this reference, may be utilized to remove some or substantially all of the catalyst material from the table 22. Such leaching process may be carried out following sintering of the table 22 (i.e., following the first stage 2701 of the two-step HPHT process 2700), before or after attachment to supporting substrate 24.

In a further embodiment, a table 22 may, after formation, be secured to a supporting substrate by brazing or adhesive bonding.

Additional non-limiting example embodiments of the disclosure are described below.

Embodiment 1: A polycrystalline compact table for a cutting element, the table comprising: a first region of super hard material grains having a first property; and a second region of super hard material grains having a second property differing from the first property, the first region and the second region defining a grain interface having a curved portion in a vertical cross-section of the table.

Embodiment 2: The polycrystalline compact table of Embodiment 1, wherein the first property comprises a first average grain size and the second property comprises a second average grain size.

Embodiment 3: The polycrystalline compact table of Embodiment 1, wherein the first property comprises a first super hard material volume density and the second property comprises a second super hard material volume density.

Embodiment 4: The polycrystalline compact table of any one of Embodiments 1 through 3, wherein the super hard material grains comprise at least one of diamond and polycrystalline cubic boron nitride.

Embodiment 5: The polycrystalline compact table of any one of Embodiments 1 through 4, wherein the grain interface further defines another curved portion in a horizontal cross-section of the table.

Embodiment 6: The polycrystalline compact table of any one of Embodiments 1 through 5, wherein the grain interface is entirely curved.

Embodiment 7: The polycrystalline compact table of any one of Embodiments 1 through 6, further comprising a third region of super hard material grains having a third property differing from the first property and the second property.

Embodiment 8: The polycrystalline compact table of any one of Embodiments 1 through 7, wherein: the first region of super hard material grains occupies a portion of a horizontal plane in the table; and the second region of super hard material grains occupies another portion of the horizontal plane in the table.

Embodiment 9: The polycrystalline compact table of any one of Embodiments 1 through 8, wherein the first region of super hard material and the second region of super hard material form at least a partial toroid.

Embodiment 10: The polycrystalline compact table of Embodiment 9, wherein the at least partial toroid comprises a vertical cross section in which the first region of super hard material and the second region of super hard material define a swirl shape.

Embodiment 11: A polycrystalline compact table for a cutting element, the table comprising: a first plurality of discrete regions of first grains of a super hard material; and a second plurality of discrete regions of second grains of the super hard material, the second grains having a different property than a property of the first grains; at least one discrete region of the first plurality vertically disposed between at least two discrete regions of the second plurality.

Embodiment 12: The polycrystalline compact table of Embodiment 11, wherein the first plurality of discrete regions and the second plurality of discrete regions define a pattern repeating across a horizontal cross-section of the table.

Embodiment 13: The polycrystalline compact table of Embodiment 11, further comprising a non-planar grain interface between at least one region of the first plurality and at least one region of the second plurality.

Embodiment 14: The polycrystalline compact table of any one of Embodiments 11 through 13, further comprising at least one region of third grains of the super hard material.

Embodiment 15: The polycrystalline compact table of Embodiment 11, wherein the first plurality of discrete regions and the second plurality of discrete regions define a pattern repeating through a vertical cross-section of the table.

Embodiment 16: A method of forming a polycrystalline compact for a cutting element of a drilling tool, the method comprising: forming a table structure comprising: forming a first region of first grains of super hard material having a first property; and forming a second region of second grains of super hard material having a second property; and subjecting the table structure to a high-pressure, high temperature process to sinter the first grains and the second grains.

Embodiment 17: The method of Embodiment 16, wherein: forming a first region of first grains of super hard material comprises forming a precursor structure having an exterior surface occupying more than one horizontal plane; and forming a second region of second grains of super hard material comprises filling negative space defined by the precursor structure with the second grains of super hard material to form the table structure comprising the first region of the first grains and the second region of the second grains at least partially laterally adjacent to the first region of the first grains.

Embodiment 18: The method of Embodiment 17, wherein forming a precursor structure comprises forming a relief structure in the exterior surface.

Embodiment 19: The method of Embodiment 17, wherein forming a precursor structure comprises forming a precursor structure having a curved exterior surface.

Embodiment 20: The method of Embodiment 17, wherein forming a precursor structure comprises forming a precursor structure defining therein a plurality of voids comprising the negative space.

Although the foregoing description contains many specifics, these are not to be construed as limiting the scope of the present invention, but merely as providing certain embodiments. Similarly, other embodiments of the invention may be devised that do not depart from the scope of the present invention. For example, materials, sizes, densities, shapes, techniques, and conditions described herein with reference to one embodiment also may be provided in others of the embodiments described herein. The scope of the invention is, therefore, indicated and limited only by the appended claims and their legal equivalents, rather than by the foregoing description. All additions, deletions, and modifications to the invention, as disclosed herein, which fall within the meaning and scope of the claims, are encompassed by the present invention.

What is claimed is:

1. A polycrystalline compact table for a cutting element, the table comprising:

a first plurality of discrete regions of super hard material grains having a first property;

a second plurality of discrete regions of super hard material grains having a second property differing from the first property; and at least one discrete region of the first plurality of discrete regions vertically disposed between at least two discrete regions of the second plurality of discrete regions.

2. The polycrystalline compact table of claim 1, wherein the first property comprises a first average grain size and the second property comprises a second average grain size.

3. The polycrystalline compact table of claim 1, wherein the first property comprises a first super hard material volume density and the second property comprises a second super hard material volume density.

4. The polycrystalline compact table of claim 1, wherein the super hard material grains comprise at least one of diamond and cubic boron nitride.

5. The polycrystalline compact table of claim 1, wherein an interface between a discrete region of the first plurality and a discrete region of the second plurality further defines a curved portion in a horizontal cross-section of the table.

6. The polycrystalline compact table of claim 1, wherein an interface between a discrete region of the first plurality and a discrete region of the second plurality is entirely curved.

7. The polycrystalline compact table of claim 1, further comprising a third region of super hard material grains having a third property differing from the first property and the second property.

8. The polycrystalline compact table of claim 1, wherein:

a discrete region of the first plurality of super hard material grains occupies a portion of a horizontal plane in the table; and a discrete region of the second plurality of super hard material grains occupies another portion of the horizontal plane in the table.

9. The polycrystalline compact table of claim 1, wherein the first plurality of discrete regions of super hard material and the second plurality of discrete regions of super hard material form at least a partial toroid.

10. The polycrystalline compact table of claim 9, wherein the at least partial toroid comprises a vertical cross section in which the first plurality of discrete regions of super hard material and the second plurality of discrete regions of super hard material define a swirl shape.

11. A polycrystalline compact table for a cutting element, the table comprising:

a first plurality of discrete regions of first grains of a super hard material;

a second plurality of discrete regions of second grains of the super hard material, the second grains having a different property than a property of the first grains; and at least one discrete region of the first plurality vertically disposed between at least two discrete regions of the second plurality.

12. The polycrystalline compact table of claim 11, wherein the first plurality of discrete regions and the second plurality of discrete regions define a pattern repeating across a horizontal cross-section of the table.

13. The polycrystalline compact table of claim 11, further comprising a non-planar interface between at least one discrete region of the first plurality and at least one discrete region of the second plurality.

14. The polycrystalline compact table of claim 11, further comprising at least one region of third grains of the super hard material.

15. The polycrystalline compact table of claim 11, wherein the first plurality of discrete regions and the second plurality of discrete regions define a pattern repeating through a vertical cross-section of the table.

16. A method of forming a polycrystalline compact for a cutting element of a drilling tool, the method comprising:

forming a table structure comprising:

forming a first plurality of discrete regions of first grains of super hard material having a first property;

forming a second plurality of discrete regions of second grains of super hard material having a second property; and vertically disposing at least one discrete region of the first plurality between at least two discrete regions of the second plurality; and subjecting the table structure to a high-pressure, high-temperature process to sinter the first grains and the second grains.

17. The method of claim 16, wherein:

forming a first plurality of discrete regions of first grains of super hard material comprises forming a precursor structure having an exterior surface occupying more than one horizontal plane; and forming a second plurality of discrete regions of second grains of super hard material comprises filling negative space defined by the precursor structure with the second grains of super hard material to faun the table structure comprising the first plurality of discrete regions of the first grains and the second plurality of discrete regions of the second grains at least partially laterally adjacent to the first plurality of discrete regions of the first grains.

18. The method of claim 17, wherein forming a precursor structure comprises forming a relief structure in the exterior surface.

19. The method of claim 17, wherein forming a precursor structure comprises forming a precursor structure having a curved exterior surface.

20. The method of claim 17, wherein forming a precursor structure comprises forming a precursor structure defining therein a plurality of voids comprising the negative space.

* * * * *